US005739454A

United States Patent [19]

Kunimoto

[11] Patent Number: 5,739,454

[45] Date of Patent: Apr. 14, 1998

[54] METHOD AND DEVICE FOR SETTING OR SELECTING A TONAL CHARACTERISTIC USING SEGMENTS OF EXCITATION MECHANISMS AND STRUCTURES

[75] Inventor: Toshifumi Kunimoto, Hamamatsu, Japan

[73] Assignee: Yamaha Corporation, Japan

[21] Appl. No.: 736,516

[22] Filed: Oct. 24, 1996

[30] Foreign Application Priority Data

Oct. 25, 1995 [JP] Japan ..... 7-301989

[51] Int. Cl.[6] ..... G10H 1/18; G10H 7/00

[52] U.S. Cl. ..... 84/615; 84/622

[58] Field of Search ..... 84/615, 622, 653, 84/659

[56] References Cited

U.S. PATENT DOCUMENTS

| | | | |
|---|---|---|---|
| 4,554,857 | 11/1985 | Nishimoto . | |
| 4,862,783 | 9/1989 | Suzuki | 84/622 |
| 5,040,448 | 8/1991 | Matsubara et al. | 84/622 |
| 5,153,829 | 10/1992 | Furuya et al. | 84/622 X |
| 5,212,334 | 5/1993 | Smith . | |
| 5,220,117 | 6/1993 | Yamada et al. . | |
| 5,260,508 | 11/1993 | Bruti et al. | 84/622 |
| 5,331,111 | 7/1994 | O'Connell . | |
| 5,559,301 | 9/1996 | Bryan, Jr. et al. | 84/659 X |

FOREIGN PATENT DOCUMENTS 5-143079 6/1993 Japan .

*Primary Examiner*—Jonathan Wysocki
*Assistant Examiner*—Jeffrey W. Donels
*Attorney, Agent, or Firm*—Graham & James LLP

[57] ABSTRACT

A tone setting device includes an operating section for selecting segments in combination from among various segments of exciting mechanisms and structures employed in plural types of musical instruments, and a data supply section supplies tone setting data, corresponding to the combination of the selected segments, as data for setting a characteristic of a tone. By thus combining segments of desired musical instruments, a free tone selection can be conducted easily in such a form where the selected tone color can be readily recognized by a human operator. Also, a plurality of parameters are allocated to a single operator so that the parameters can be simultaneously adjusted by respective unique amounts of change based on operation of the same operator.

14 Claims, 15 Drawing Sheets

PIPE/STRING MODELLING SECTION 40

METHOD AND DEVICE FOR SETTING OR SELECTING A TONAL CHARACTERISTIC USING SEGMENTS OF EXCITATION MECHANISMS AND STRUCTURES

FIELD OF THE INVENTION

BACKGROUND OF THE INVENTION

The present invention relates generally to tone setting methods and devices which are suitable for use in electronic musical instruments or tone generating devices employing a so-called physical model tone generator, and more particularly to a tone setting method and device which permit tone setting or editing operation exactly according with feeling or intuition of a human operator.

One of the most common tone color selecting methods employed in electronic musical instruments today is to directly select a tone color corresponding to a desired musical instrument from among a variety of tone colors prestored in correspondence to various natural musical instruments such as piano and violin. On the other hand, in electronic musical instruments or tone synthesizing devices, such as music synthesizers, of a type which is designed to freely synthesize tones of optional colors which do not necessarily correspond to tone colors of existing musical instruments, a color of each tone to be synthesized is created freely by individually setting or adjusting a value of each of tone synthesizing parameters. Each of such conventionally-known tone synthesizing parameters corresponds to either a tone forming factor such as a pitch or volume, or an electrical circuit element as is the case with a filter coefficient.

Examples of recently developed tone generators include a physical model tone generator, the basic technique of which is disclosed for example in U.S. Pat. No. 5,212,334. Subsequent Japanese Patent Laid-open Publication No. HEI-5-143079 and many patent applications show techniques relating to the physical model tone generator. These physical model tone generators are designed to create tones on the physical tone generating principle of a natural musical instrument, by electrically or electronically simulating the instrument's physical sounding mechanism. However, even in cases where such a relatively new tone generator is employed, methods for selecting a tone color of each tone to be synthesized and for variably setting/adjusting various parameters still remain within the level of the above-mentioned prior art.

Particularly, because determination of a pitch of each tone pitch to be synthesized, in effect, involves very complex operations in the physical model tone generators, it has been a common practice to synthesize tones using algorithms having previously undergone proper tuning at the manufacturing stage. Primary factors that the user can adjust are just those relating to real-time performance operation such as breath pressure and embouchure, and it is not possible for the user to optionally create algorithms for the physical model tone generator so as to generate novel sounds that have never existed before. Although completely novel sounds can of course be created by the physical model tone generator if appropriate algorithms are designed in advance at the manufacturing stage, no prior technique has been developed which facilitates the designing of such algorithms at the time of the user's setting and editing of desired tones.

SUMMARY OF THE INVENTION

It is therefore an object of the present invention to provide a tone setting method and device which permit tone setting or editing operation exactly according with human operator's (or user's) intuition. More specifically, the present invention seeks to provide a tone setting method and device which allow a tone characteristic (normally, a tone color) based on an optional physical model to be selected easily with a relatively high level of freedom or flexibility at the time of the user's setting and editing of desired tones.

It is another object of the present invention to provide a tone setting device which is capable of adjusting and setting various tone setting or controlling parameters with increased efficiency in a manner exactly according with an operator's (or user's) feeling.

In order to accomplish the above-mentioned objects, the present invention provides a tone setting device for a tone generator which generates a musical tone signal based on tone setting data in accordance with a predetermined algorithm, and which is characterized in that it comprises: a memory section for storing a plurality of tone setting data; a operating section for selecting segments in combination from among various segments of exciting mechanisms and structures in plural types of musical instruments or sound generating objects; and a data supply section for reading out from the memory section tone setting data corresponding to the combination of the segments selected by the operating section, as data for setting a characteristic of a tone, and for supplying the read-out tone setting data to the tone generator, whereby a characteristic of a tone to be generated is set by combining the segments of any of the musical instruments or tone generating structures.

The present invention is characterized primarily by the provision of the operating section for selecting segments from among various segment of exciting mechanisms and structures of plural types of musical instruments or sound generating objects. With this operating section, the human operator (or user) is allowed to optionally select segments of the exciting mechanisms and structures of a plurality of desired musical instruments or sound generating objects, to thereby easily model such a novel, imaginary musical instrument that is for example comprised of a combination of selected segments of different musical instruments and freely create sounds having never existed before through a very simple selection exactly according with his intuition. For example, the "segments" into which the exciting mechanisms and structures of musical instruments include various reed and mouthpiece portions and pipe portions of various shapes in wind instruments, string portions plucked with a finger and rubbed with a bow in stringed instruments, and resonators and body portions of given musical instruments. Because the exciting mechanisms and structures of musical instruments may be divided into segments in a variety of ways depending on the desired design, e.g., into relatively rough or fine segments, the scope of the present invention should of course not be limited to the preferred embodiments described hereinafter. Further, the words "exciting mechanisms and structures of musical instruments" as used herein should be interpreted as meaning not only fixed structures and components of musical instruments such as a reed, pipe and string, but also mechanisms relating to the player's actual performance actions such as a portion causing vibration by a string being plucked with a finger, a portion causing vibration by a string being rubbed with a bow as noted above (i.e., exciting mechanisms). Segments of the exciting mechanisms and structures of other sound generating objects than the existing musical instruments, such as lips (whistling object) of a human being, may also be selected for the segment combination.

Thus, in cases where the tone setting device of the present invention is applied to an electronic musical instrument or tone generating device employing a physical model tone generator, setting or selection of tonal characteristics (normally, tone color) can be easily conducted with a relatively high level of freedom, without a need for the human operator or user to have a particular knowledge of complicated algorithm design. Further, the tone setting device of the present invention may of course be applied to an electronic musical instrument or tone generating device employing another type tone generator than the physical model tone generator; also in such a case, setting or selection of tonal characteristics (tone color) exactly according with the user's intuition can be set or selected with ease, by optionally selecting desired segments of the exciting mechanisms and/or structures of the musical instruments.

In the present invention, the data supply section is also provided in connection with the above-mentioned operating section and the memory section so that tone setting data corresponding to the combination selected by the operating section is read out from the memory section and supplied to the tone generator as data for setting a characteristic of a tone. In turn, the tone generator conducts tone synthesis and tone color formation on the basis of the supplied tone setting data. Because the tone setting data supplied by the supply section corresponds to a combination of selected segments and a characteristic of a tone to be generated is set on the basis of such tone setting data, tone synthesis and tone color formation are effected which correspond to the combination of selected segments of exciting mechanisms and/or structures of musical instruments. In one preferred embodiment, the memory section may have stored therein sets of tone setting data corresponding to possible combinations of segments of the exciting mechanisms and/or structures of musical instruments or may include any other necessary component.

Because it is known that the tone setting data includes a plurality of parameters for setting a characteristic of a tone, the tone setting device may further comprise a parameter adjusting section for optionally changing or adjusting a value of any of the parameters.

In one preferred embodiment, the operating section may be arranged to classify the segments of the musical instruments into a plurality of groups in accordance with respective functions of the segments and selects a desired one of the segments for each of the groups, so as to provide a combination of the respective segments selected for the individual groups. In this case, these groups include a group corresponding to the segments having a function of exciting vibration in the musical instrument, and a group corresponding to the segments having a function of causing resonance in the musical instrument. In one embodiment described later, the first-said group corresponding to the segments having a function of exciting vibration is classified under the name of "driver", while the second-said group corresponding to the segments having a function of causing resonance is classified under the name of "pipe/string". These two groups are just exemplary, and the segments may of course be classified into other groups. In this case, the operating section preferably includes a display section for displaying the selectable segments for each of the groups, so as to provide an effective visual guide for the human operator in selecting desired ones of the segments. In such a case, symbolic graphic representations schematically showing the exciting mechanisms or structures corresponding to the segments may be provided to allow the human operator to more readily recognize the selectable segments.

In one preferred embodiment, the operating section includes a first section for selecting desired ones of the segments, and a second section for, if the combination of the selected segments has a plurality of variations, selecting a desired one of the variations.

According to another aspect, the principle of the present invention may be embodied as a method of selecting tone setting data. As an example, the method of the present invention comprises a step of dividing exciting mechanisms and structures of plural types of musical instruments or sound generating objects into a plurality of segments and displaying the segments on a display, a step of selecting desired ones of the segments displayed on the display, a step of displaying on the display information indicative of a combination of the segments selected by the step of selecting, and a step of supplying tone setting data corresponding to the combination of the segments as data for setting a characteristic of a tone.

Further, a tone setting device according to another aspect of the present invention comprises at least one data editing operator, the operator being of a type that can be operated to move within respective predetermined ranges in positive and negative regions, an allocating section for allocating at least two parameters for setting or controlling a characteristic of a tone, as parameters to be edited in value via the operator, and a control section for, in response to operation of the same operator, variably adjusting values of the parameters to be edited via the operator, by different amounts corresponding to a predetermined operation amount of the operator, each of the different amounts being set separately for each of the positive and negative regions of the operator.

According to the present invention thus arranged, at least two parameters, rather than just one parameter, are designated for editing via the single data editing operator. Thus, values of two or more parameters to be edited are variably adjusted simultaneously in response to operation of the same single operator, and this feature permits efficient adjustment or setting of various tone setting or controlling parameters.

The operator may be of a type (e.g., sliding type) that can be worked to move within respective predetermined ranges in positive and negative regions, and the different amounts corresponding to a predetermined operation amount of the operator is set separately for each of the positive and negative regions. Thus, amounts of adjustment of the parameters corresponding to a single operator can be made significantly different from each other, and by greatly differentiating the level of effect (degree of adjustment) in relation to a specific operational position (in the positive or negative position) parameter by parameter, even more proper adjustment can be attained, for each of the parameters, by working the same operator.

The control section may variably adjust values of each of the parameters by different amounts corresponding to a predetermined operation amount of the operator. Thus, even with a same operation amount, different level of effect (degree of adjustment) by the operation can be set separately for each of the parameters, so that proper adjustment can be effectively achieved for each of the parameters while processing exactly according with the human operator's (or user's) feeling is performed in response to single operation of the operator.

It is preferred that the at least two parameters allocated (i.e., designated) for the single operator cooperatively, rather than separately, set or control a tonal characteristic corresponding to a particular control purpose allocated to the operator. Specifically, the operator corresponds to one desired sensuous tonal characteristic factor, and the at least two parameters designated for the operator cooperate to set or control a tonal characteristic so as to control the single sensuous tonal characteristic factor. If a given operator is designed to control "brightness" of a tone color as the single sensuous tonal characteristic factor, at least two parameters relating to the "brightness" control may be designated for (or allocated to) the same operator. This allows a plurality of parameters to be simultaneously set or controlled in response to operation of a single operator, without a need for the human operator to operate individual operators corresponding to the parameters for controlling one desired sensuous tonal characteristic factor. This feature provides greatly enhanced efficiency and permits parameter adjustment and setting in a manner exactly according with the human operator's (or user's) feeling.

Because the individual parameters used in the present invention are specific control-level parameters, it is likely that a same parameter is designated in relation to different sensuous tonal characteristic factors. Namely, a same parameter may sometimes be designated for at least two operators as one of the parameters to be edited via the operators. In such a case, it is preferable that for each of the operators for which the same parameter is designated, a change amount of the parameter value corresponding to a predetermined operation amount be set independently of the other operator. Namely, even with the same parameter, the variable amount of adjustment of the parameter can differ between the time when one of the operators is worked and the time when the operator is worked. This arrangement permits proper tone setting or control exactly according with the human operator's feeling.

The tone setting device of the present invention may be implemented either by a dedicated hardware device or by a combination of a general-purpose computer hardware device and dedicated software program. The preferred embodiment of the present invention will be described hereinafter as being implemented by an example of the combination of a general-purpose computer hardware device and dedicated software program. In this connection, a general-purpose selecting/operating section including a display and a limited number of function switches or ten-keys, cursor key or mouse may be used, in stead of a dedicated operator hardware device, as the operating section for selecting the segments of different types of musical instruments. The same applies to the above-mentioned at least one data editing operator. Stated differently, the operator may be implemented by a representation of a virtual operator on the display and a switch associated therewith.

BRIEF DESCRIPTION OF THE DRAWINGS

The preferred embodiments of the invention will be described in greater detail below with reference to the accompanying drawings, in which.

DETAILED DESCRIPTION OF THE PREFERRED EMBODIMENTS

Figure 1:
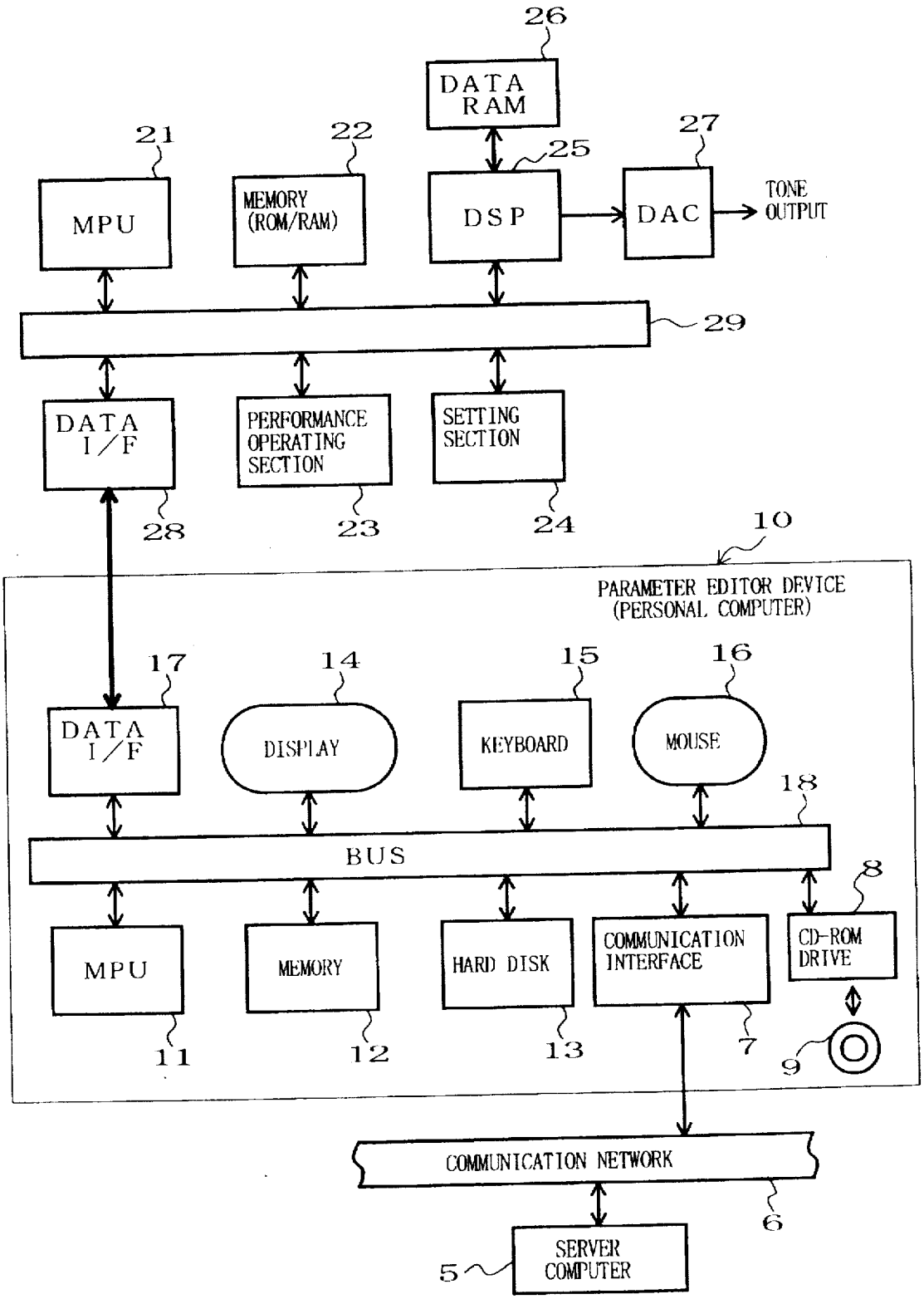
FIG. 1 is a hardware block diagram of an embodiment of the present invention.

FIG. 1 is a hardware block diagram of a parameter editor device 10 which is an embodiment of a tone setting device of the present invention. In the embodiment, the parameter editor device 10 is implemented using a personal computer that is provided separately from the body of an electronic musical instrument or tone synthesizing device.

The hardware of the parameter editor device 10 generally comprises a microprocessor unit (hereinafter referred to as a MPU) 11, a memory 12 including a data storing and working RAM (random access memory), a magnetic-recording hard disk device 13 for recording or having prestored therein necessary programs and/or various data, a CRT, crystal or plasma type display 14, a keyboard 15 for entering letters and numerals, a mouse 16 for entering instructions with reference to displayed information on the display 14, and a data interface (I/F) 17. These components are interconnected via a bus 18 for exchange of data and addresses. A predetermined edit program associated with the present embodiment is prestored on the hard disk device 13 and/or memory 12 so as to be executed under the control of the MPU 11. If necessary, the memory 12 may include a ROM (read-only memory) having prestored therein other necessary programs and/or other data. As will be later described in connection with exemplary detailed behavior of the parameter editor device 10 based on the above-noted edit program, the primary function of the editor device 10 is to set or edit various characteristics of each tone to be generated or synthesized, namely, to effect a process for selecting or setting a tone color or tonal effect and for optionally setting or changing values of individual tonal characteristic setting parameters.

Referring to an example structure of the body of the electronic musical instrument or tone synthesizing device, it generally comprises a MPU 21, a memory 22 including a ROM having prestored therein necessary programs and/or other data and a data storing and working RAM, a performance operating section 23 including a keyboard for designating a pitch, etc. of each tone to be generated, a setting section 24 for selectively selecting or setting a color, volume and effect of each tone to be generated, a tone generator section comprised of a digital signal processor (hereinafter referred to as a DSP) 25 for synthesizing tones and a data RAM 26 for use with the DSP 25, a D/A converter (DAC) 27 for converting digital data of each synthesized tone signal into analog representation, and a data interface 28. These components are interconnected via a bus 29 for exchange of data and addresses. In the body of the electronic musical instrument or tone synthesizing device, as well known, various processes, such as for scanning the performance operating section 23 and setting section 24 for their current operating and setting states and assigning each tone to be generated to any one of tone generating channels, are executed under the control of the MPU 21, and data and/or parameters necessary for tone generation are supplied to the DSP 25 so that tones are generated in accordance with tone synthesizing algorithms set in the DSP 25. Of course, the body of the electronic musical instrument or tone synthesizing device may be an automatic performance device such as a sequencer as long as it is provided with a tone generating device based on some type of a tone generating technique. Further, as needed, the performance operating section 23 may include a touch sensor, mouth-piece-style performance operator and/or performance operating means for detecting a gesture of a hand or foot in addition to or in place of the pitch designating operator, and may be arranged to supply performance control information in real time.

The data interface 17 of the parameter editor device 10 and data interface 28 of the body of the electronic musical instrument or tone synthesizing device are connected with each other in such a manner that various tonal characteristic setting parameters (for wider interpretation, the words "tone color setting data" will sometimes be used hereinafter) set or edited by the parameter editor device 10 are supplied to the body of the electronic musical instrument: or tone synthesizing device. Each parameter thus supplied to the body is either temporarily stored into a designated area of the memory 22 or directly passed to the DSP 25. In synthesizing a tone of a pitch designated via the performance operating section 23, the DSP 25 uses the tonal characteristic setting parameters supplied from the parameter editor device 10 to set corresponding tonal characteristics and thereby generates a tone having the thus-set tonal characteristics (which may be called a tone color in a broader sense).

The parameter editor device 10 may include a removably-attachable external recording medium such a CD-ROM (compact disk) 9 which has recorded therein various data and an optional operating program, e.g., the edit program. Such an operating program and data stored in the CD-ROM 9 can be read out by means of a CD-ROM drive 8 to be then transferred for storage on the hard disk device 13. This facilitates installation and version-up of the operating program, namely, the edit program. The removably-attachable external recording medium may be other than the CD-ROM, such as a floppy disk and magneto optical disk (MO).

A communication interface 7 may be connected to the bus 18 so that the editor device 10 can be connected via the interface 7 to a communication network 6 such as a LAN (local area network), internet and telephone line network and can also be connected to an appropriate sever computer 5 via the communication network 6. Thus, where the operating program, namely, the edit program and various data are not stored on the hard disk device 13, these operating program and data can be received from the server computer 5 and downloaded onto the hard disk device 13. In such a case, the editor device 10, i.e., a "client", sends a command requesting the server computer 5 to download the operating program and various data by way of the communication interface 7 and communication network 6. In response to the command from the editor device 10, the server computer 5 delivers the requested operating program and data to the device 10 via the communication network 6. The editor device 10 completes the necessary downloading by receiving the operating program and data via the communication network 6 and storing these onto the hard disk device 13.

It should be understood here that the editor device 10 of the present invention may be implemented by installing the operating program and various data corresponding to the present invention in a commercially available personal computer. In such a case, the operating program and various data corresponding to the present invention may be provided to users in a recorded form in a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

Because detailed nature of parameters to be set or edited by the parameter editor device 10 concerns details of the tone synthesizing algorithms in the DSP 25, exemplary details of the synthesizing algorithms in the DSP 25 will be outlined below prior to describing details of the parameter editor device 10.

Figure 2:
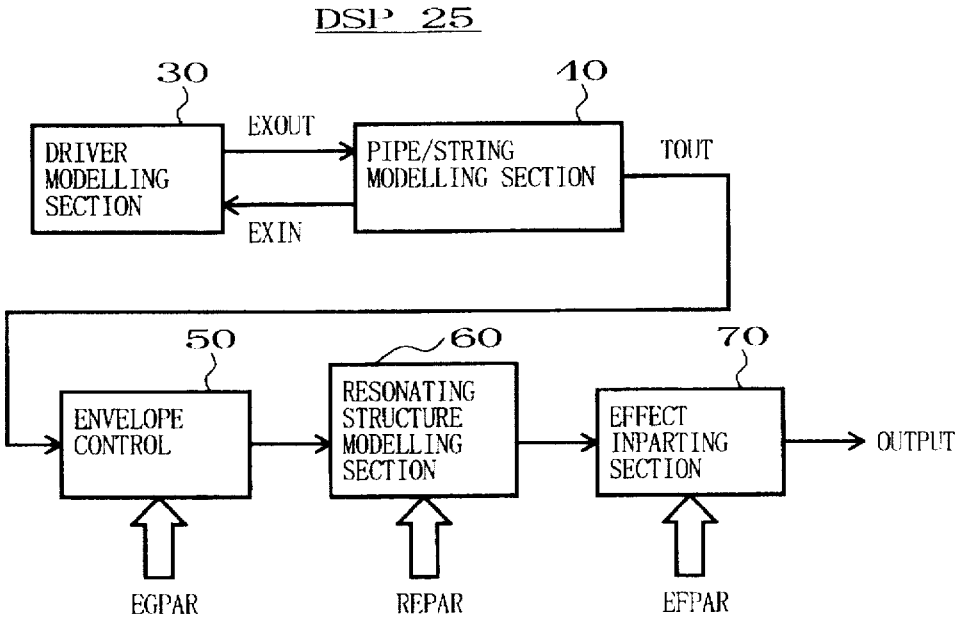
FIG. 2 is a block diagram illustrating various functions performed by a digital signal processor (DSP) that is used as a tone generator device of FIG. 1.

In the preferred embodiment, the DSP 25 is designed to execute a tone synthesizing process in accordance with the principle of the physical model tone generator. FIG. 2 is a block diagram showing the tone synthesizing process in terms of individual functions performed by the DSP 25. In FIG. 2, blocks of driver modelling and pipe/string modelling sections 30 and 40 represent functions of executing a main portion of the tone synthesizing process in accordance with the principle of the physical model tone generator. The driver modelling and pipe/string modelling sections 30 and 40 correspond to and model structural portions or segments of musical instruments. More specifically, the driver modelling section 30 is intended to model a segment of a musical instrument which excites vibration in the instrument, and the pipe/string modelling section 40 is intended to model a segment of a musical instrument which has a function of causing resonance in the instrument, such as a pipe of a wind instrument or a string of a stringed instrument. The pipe/string modelling section 40 includes a delay line to variably delay a signal. As well known, the tone synthesizing principle is such that the driver modelling and pipe/string modelling sections 30 and 40 each generally form a closed loop for circulating signals therethrough so that each signal excited in the driver modelling section 30 is propagated via the pipe/string modelling section 40 and thereby an excited signal, i.e., tone signal, is synthesized by the signal circulation through the closed loop.

Figure 3:
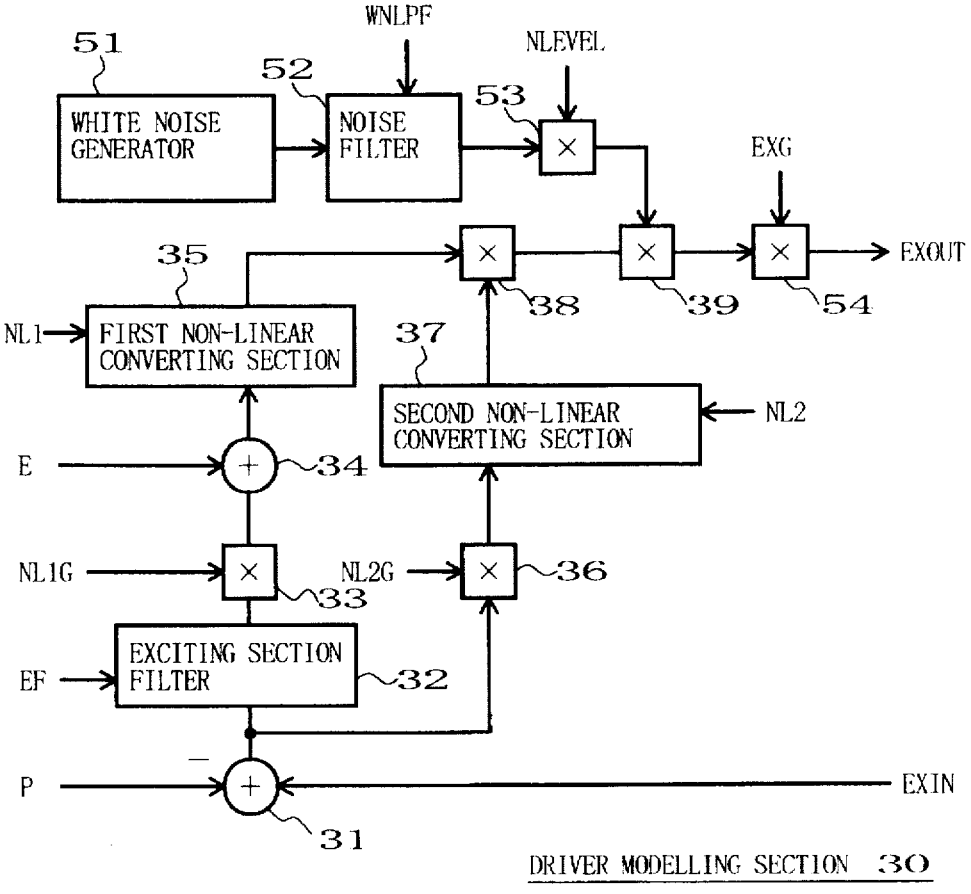
FIG. 3 is a block diagram illustrating a detailed example of processing executed by a driver modelling section of FIG. 2.
Figure 4:
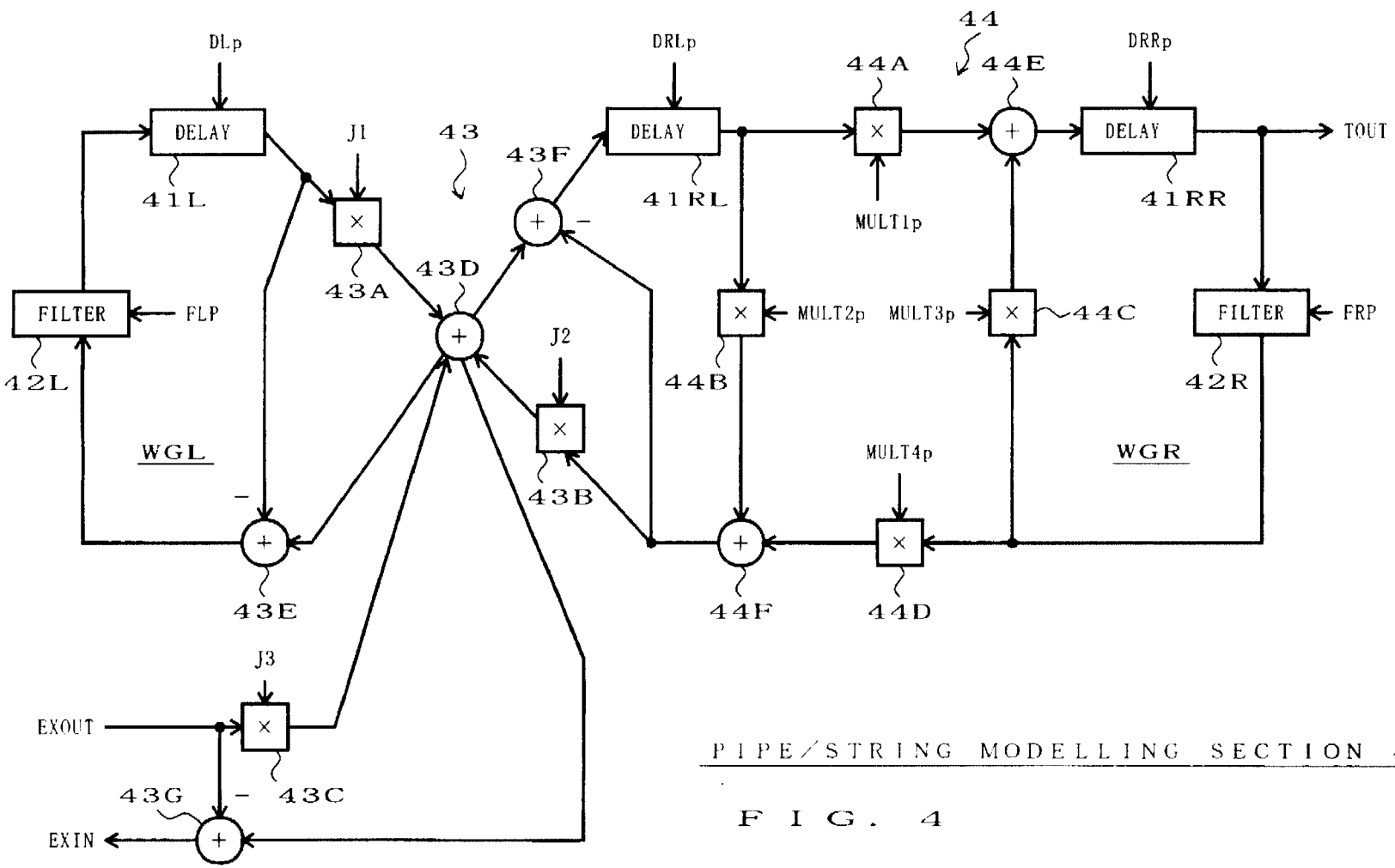
FIG. 4 is a block diagram illustrating a detailed example of processing executed by a pipe/string modelling section of FIG. 2.

FIG. 3 is a functional block diagram illustrating a detailed example of a processing algorithm executed by the driver modelling section 30, and FIG. 4 is a functional block diagram illustrating a detailed example of a processing algorithm executed by the pipe/string modelling section 40. These algorithms are known for example from Japanese Patent Laid-open Publication No. HEI-5-143079 and will be described below only briefly.

In the example of FIG. 3, of various parameters denoted by respective reference characters, pressure signal P and embouchure signal E are supplied in response to human operator's (user's) operation on the performance operating section 23 in the body of the electronic musical instrument, and other parameters are in principle supplied from the parameter editor device 10 although they may be supplied in response to human operator's setting operation on the performance operating section 23 or the like.

The pressure signal P is equivalent to an exciting signal given in response to key depression or other performance operation, and the signal P corresponds, for example, to blowing pressure (breath pressure) in the wind instrument model or string-plucking force or bow-drawing speed in the stringed instrument model. Signal EXIN fed back from the pipe/string modelling section 40 shown in FIG. 4 is applied to an adder 31, where the pressure signal P is subtracted from the feedback signal EXIN.

An exciting section filter 32 is set to specific filter characteristics based on an exciting section filter parameter EF so as to filter the output signal of the adder 31 in accordance with the filter characteristics, to thereby simulate frequency response characteristics of an exciting structure.

The output signal of the exciting section filter 32 is passed to a multiplier 33, where it is multiplied by first nonlinear-converting-section input gain parameter NL1G so as to be controlled in gain. The gain-controlled signal is then added with embouchure signal E via an adder 34, so that the addition result is passed to a first nonlinear converting section 35. The embouchure signal E is a control signal to offset an input signal to the first nonlinear converting section 35 and corresponds to an embouchure condition in a wind instrument (way of applying the lips to the mouth piece or closing the lips) or string-rubbing pressure of a bow in a stringed instrument.

The pressure signal P and embouchure signal E, which are supplied in response to real-time performance operation on the performance operating section 23 or appropriate tone generating event in an automatic performance, may be controlled in their respective values on the basis of predetermined control parameters given from the parameter editor device 10.

In the meantime, the output signal of the adder 31 is passed to a multiplier 36, where it is multiplied by second nonlinear-converting-section input gain parameter NL2G so as to be controlled in gain. The gain-controlled signal is then passed to a second nonlinear converting section 37.

The first and second nonlinear converting sections 35 and 37 apply nonlinear conversion to each signal circulating through the closed loop so as to simulate desired characteristics, where given nonlinear converting sections are selected depending on respective parameters NL1 and NL2 input to the sections 35 and 37. For example, in the wind instrument model, the first nonlinear converting section 35 simulates reed opening/closing characteristics and the second nonlinear converting section 37 simulates characteristics of air pressure within the pipe (Graham function).

The output signals of the first and second nonlinear converting sections 35 and 37 are multiplied via a multiplier 38, and the multiplied result of the multiplier 38 is further multiplied by a noise signal via another multiplier 39. This noise signal is obtained by processing white noise, generated by a white noise generator 51, via a noise filter 52 set to a low-pass filter characteristic based on white noise cut-off frequency parameter WNLPF and further level-controlling the filtered white noise via a multiplier 53 using noise output level parameter NLEVEL. The output signal of the multiplier 39 is passed to still another multiplier 54, where it is multiplied by driver output gain parameter EXG. The output signal of the multiplier 54 is supplied, as output signal EXOUT of the driver modelling section 30, to the pipe/string modelling section 40 shown in FIG. 4.

With the above-described arrangement, structural segments of the exciting structure in various musical instruments (natural instruments such as wind and stringed instruments) can be modelled by variably controlling the parameters NL1, NL2, NL1G, NL2G, . . . to be used in the driver modelling section 30.

Referring now to FIG. 4, the pipe/string modelling section 40 generally comprises a left waveguide section WGL including a delay line 41L and a left end filter 42L, a right waveguide section WGR including a delay line 41RL and a right end filter 42R, and a junction section 43 connecting the left and right waveguide sections WGL and WGR with the above-mentioned driver modelling section 30. The junction section 43 includes a multiplier 43A for multiplying an output signal of the left waveguide section WGL by junction coefficient parameter J1, a multiplier 43B for multiplying an output signal of the right waveguide section WGR by junction coefficient parameter J2, and a multiplier 43C for multiplying output signal EXOUT given from the driver modelling section 30 by junction coefficient parameter J3. The junction section 43 further includes an adder 43D for summing respective output signals of the multipliers 43A to 43C, an adder 43E for subtracting the output signal of the left waveguide section WGL from the output signal of the adder 43D to feed the subtraction result to the waveguide section WGL (in the illustrated example, to the left end filter 42L), an adder 43F for subtracting the output signal of the right waveguide section WGR from the output signal of the adder 43D to feed the subtraction result to the waveguide section WGR (in the illustrated example, to the delay line 41RL), and an adder 43G for subtracting the output signal EXOUT of the driver modelling section 30 to feed the subtraction result as input signal EXIN to the modelling section 30.

A tone hole junction 44 is provided between the delay lines 41RL and 41RR of the right waveguide section WGR, so as to simulate a tone hole in a wind instrument. The tone hole junction 44 includes multipliers 44A and 44B for multiplying an output signal of the delay line 41RL by tone hole coefficient parameters MULT1p and MULT2p, respectively, and multipliers 44C and 44D for multiplying an output signal of the right end filter 42R by tone hole coefficient parameters MULT3p and MULT4p, respectively. The tone hole junction 44 includes an adder 44E for adding respective output signals of the multipliers 44A and 44C to feed the addition result to the delay line 41RR, and an adder 44F for adding respective output signals of the multipliers 44B and 44D to provide the addition result as an output signal of the right waveguide section WGR.

The individual delay lines 41L, 41RL and 41RR are variably set to delay amounts depending on respective delay amount setting parameters DLp, DRLp and DRRp, so as to determine a pitch of a tone to be synthesized. Further, the left and right end filters 41L and 42R are variably set to characteristics depending on respective filter parameters FLP and FRP, so as to simulate the end structure of a pipe or string to be modelled.

By thus connecting the driver modelling section 30 between the left and right waveguide sections WGL and WGR via the junction section 43, the single algorithm as shown can be used to model the exciting structure of a stringed instrument which operates on the basis of plucking an intermediate portion of a string or drawing the bow on a string, or of a wind instrument where blowing pressure is applied to an end or intermediate portion thereof, depending on the settings of the individual junction coefficient parameters J1, J2 and J3. Also, by connecting the two delay lines 41RL and 41RR of the right waveguide section WGR via the tone hole junction section 44, it is possible to simulate a tone hole or other similar structure in a wind instrument.

In the illustrated example, the parameters are, in principle, supplied from the parameter editor device 10, of which the pitch-related parameters DLp, DRLp, DRRp and MULT1p to MULT4p are determined on the basis of delay amount table parameters DL, DRL, DRR and tone hole parameters MULT1 to MULT4 in consideration of a pitch selected via the performance operating section 23. More specifically, delay amount tables are selected corresponding to partial structures of a selected musical instrument are selected in accordance with the delay amount table parameters DL, DRL and DRR so as to read out from the selected tables delay amount setting parameters DLp, DRLp and DRRp corresponding to a pitch of a tone to be generated, so that delay amounts are variably set for the corresponding delay lines 41, 42 and 43. These delay amounts can be used to simulate different octave and tuning conditions in different exciting structures of a desired musical instrument. The tone hole coefficient parameters MULT1p to MULT4p are for setting multiplication coefficients for the multipliers 44 to 47 making up the tone hole junction section; for example, these parameters MULT1p to MULT4p can be used to simulate tone hole opening/closing states in a wind instrument so as to adjust a pitch of a tone to be generated. Thus, whether a tone hole should be opened or closed is determined on the basis of the tone hole parameters MULT1 to MULT4 supplied from the parameter editor device 10, and the tone hole coefficient parameters MULT1p to MULT4p are set in accordance with that determination.

The above-described arrangement permits modelling of structural segments of the resonating structures of various acoustic or natural musical instruments such as wind and stringed instruments.

By a combination of simulation by the driver modelling section 30 modelling a segment corresponding to the exciting function of a desired musical instrument and simulation by the pipe/string modelling section 40 modelling a partial structure corresponding to the exciting function of a desired musical instrument; tone signals are synthesized on the basis of the physical model tone generator principle. While each resultant synthesized tone signals may be extracted from any desired point of the closed loops, i.e., driver modelling section 30 and pipe/string modelling section 40, the illustrated example is designed to allow output signal TOUT to be extracted at the output side of the delay line 41RR.

Referring back to FIG. 2, each output tone signal TOUT (strictly speaking, tone signal being synthesized) from the pipe/string modelling section 40 is passed to an envelope control section 50, where the signal TOUT is imparted an envelope of amplitude characteristics such as those defining an attack, decay, sustain, release and the like. Envelope parameters EGPAR given to the envelope control section 50 are intended for setting a shape of an envelope waveform created by the section 50 and include parameters of an attack rate, attack level, release rate and the like.

Each tone signal output from the envelope control section 50 is applied to a resonating structure modelling section 60, which is intended for modelling resonance body characteristics in the event that any such characteristics can not be modelled by a combination of the above-described driver modelling section 30 and pipe/string modelling section 40. For example, in the case of a stringed instrument, the pipe/string modelling section 40 can model an exciting structure of a string itself but can not go so far as to model a resonance phenomenon by the body of violin or guitar or resonating structure of piano. So, the resonating structure modelling section 60 is additionally provided to model such a resonating structure or phenomenon. The resonating structure modelling section 60 may comprise a physical model of a closed loop structure as earlier mentioned, an appropriate formant filter circuit or the like. It should be obvious that when a selection has been made of a tone color that requires no modelling of such an additional resonating structure or phenomenon, the output tone signal need not be applied to the resonating structure modelling section 60. Resonance parameters REPAR given to the resonating structure modelling section 60 are intended for setting the resonating structure or phenomenon to be modelled by the section 60 and include a resonance type designating parameter, resonance frequency characteristic setting parameter, resonance level setting parameter and the like.

Each tone signal output from the resonating structure modelling section 60 is supplied to an effect imparting section 70, which imparts a tonal effect, such as reverberation, chorus, delay or panning effect, to the tone signal. Effect parameters EFPAR given to the effect imparting section 70 are for selecting and setting an effect to be imparted by the section and include an effect type designating parameter, effect depth setting parameter, modulation speed setting parameter and the like.

While the above-mentioned parameters EGPAR, REPAR and EFPAR are supplied from the parameter editor device 10 in the illustrated example, these parameters may of course be supplied in any other appropriate manner, for example, on the basis of settings made via the setting section 24.

A description will now be given about the parameter editor device 10.

The term "tone color" is ordinarily or customarily used as one form of representing a general property of a tone. The "tone color" in a narrow sense of the term is defined by harmonic or spectral composition of a tone as well known in the art, but the term "tone color" is used here mostly in its broad sense as one form of representing a general property of a tone although it is sometimes used in the narrow sense.

The parameter editor device 10 has three major functions as follows. The first function is to select or set a tone color as defined in the broad sense (which, for convenience of description, will be referred to as a "tone color selecting function"), the second function is to supply tone setting data for setting a tone characteristic corresponding to a single tone color thus selected or set (i.e., data for forming or creating the tone color), and the third function is to adjust, set or change a value of any of a plurality of parameters included in the tone setting data (which, for convenience of description, will be referred to as an "edit function").

The tone color selecting function of the parameter editor device 10 is characterized primarily in that it divides each of the exciting mechanisms and structures of various musical instruments into a plurality of segments to permit a selection of any desired divided segments in combination across the instruments. As operating means for this tone color selecting function, this embodiment employs a combination of the display 14 and keyboard 15 and/or mouse 16.

Figure 5:
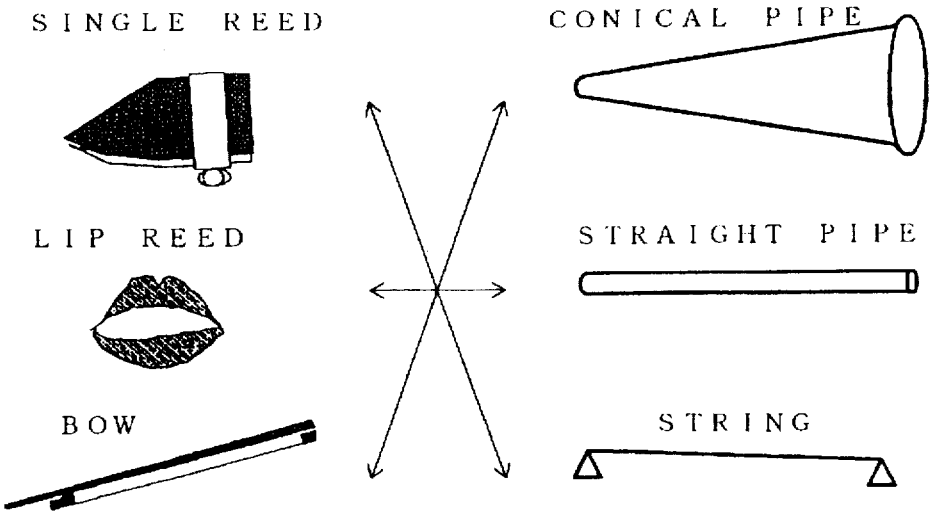
FIG. 5 is a conceptual diagram illustrating exemplary combinations of segments of exciting mechanisms and/or structures in various musical instruments.

FIG. 5 is a conceptual diagram illustrating exemplary combinations of the divided segments of the respective exciting mechanisms and/or structures of various musical instruments. In FIG. 5, the segments of the exciting mechanisms and/or structures are a single reed (segment corresponding to the exciting mechanism of a certain type of a wind instrument such as saxophone), lip reed (segment corresponding to the exciting mechanism of a certain type of a wind instrument such as trumpet), bow (segment corresponding to the exciting mechanism of a stringed instrument such as violin), conical pipe (segment corresponding to the whole or partial structure of a certain type of a wind instrument), straight pipe (segment corresponding to the whole or partial structure of a certain type of a wind instrument), and string (segment corresponding to a string of a stringed instrument). The operator or user can optionally select and combines any of these segments to thereby freely select a desired tone color or create an imitated or imaginary tone color.

Double-head arrows in FIG. 5 suggest some possible combinations of the segments, although it should be readily understood that other combinations than those shown are also possible. Also, three or more segments may be combined rather than just two segments. Further, because it is desirable to assure that a tone color corresponding to a selected combination of the segments can be actually synthesized, the possible combinations will naturally be limited by the capability of the tone generator device (DSP 25). In the detailed example below, two of the segments are selected, one for each of the driver modelling and pipe/string modelling sections 30, 40 in the DSP 25, so that a selection of a desired tone color is made by a combination of the selected segments. With such a tone color setting function, a novel tone color selection breaking through the existing concept is enabled on the basis of the user's accurate understanding and recognition. For example, a combination of the single reed and straight pipe segments permits a selection of a commonly-known tone color of clarinet, while a combination of the single reed and string segments permits a tone color of a novel, imaginary musical instrument which did not existed in the past. Then, the user can intuitively know, from the combination of the selected partial exciting mechanism and structures, what kind of tone color is created, even though the user does not have a knowledge of sophisticated tone synthesizing algorithms.

Basically, in the parameter editor device 10, the supply of a set of tone setting data corresponding to a tone color selected in the above-mentioned manner is effected by retrieving a specific one of sets of tone setting data that are prestored in a data base in corresponding relations to the tone colors selectable in the device 10.

For example, where the hard disk device 13 of FIG. 1 is used as the data base, it has prestored therein tone setting data of all the selectable tone colors, from actual tone colors of acoustic musical instruments to imaginary tone colors created by the above-noted segment combinations. In this case, a set of tone setting data corresponding to a tone color selected in the above-mentioned manner is read out from the hard disk device 13 and temporarily stored into the memory 12. Then, each individual parameter included in the set of tone setting data stored in the memory 12 is adjusted, set or changed as necessary in accordance with the edit function, and then the set of tone setting data having been edited in this manner is supplied via the data interfaces 17 and 18 to the body of the electronic musical instrument, representatively to the DSP 25. Any other memory device than the hard disk device 13 may be used as the data base, or the data base may be provided in the body of the electronic musical instrument or provided at a remote place for connection thereto via a communication line so that a necessary set of tone setting data is read out and loaded into the memory 12.

Figure 6:
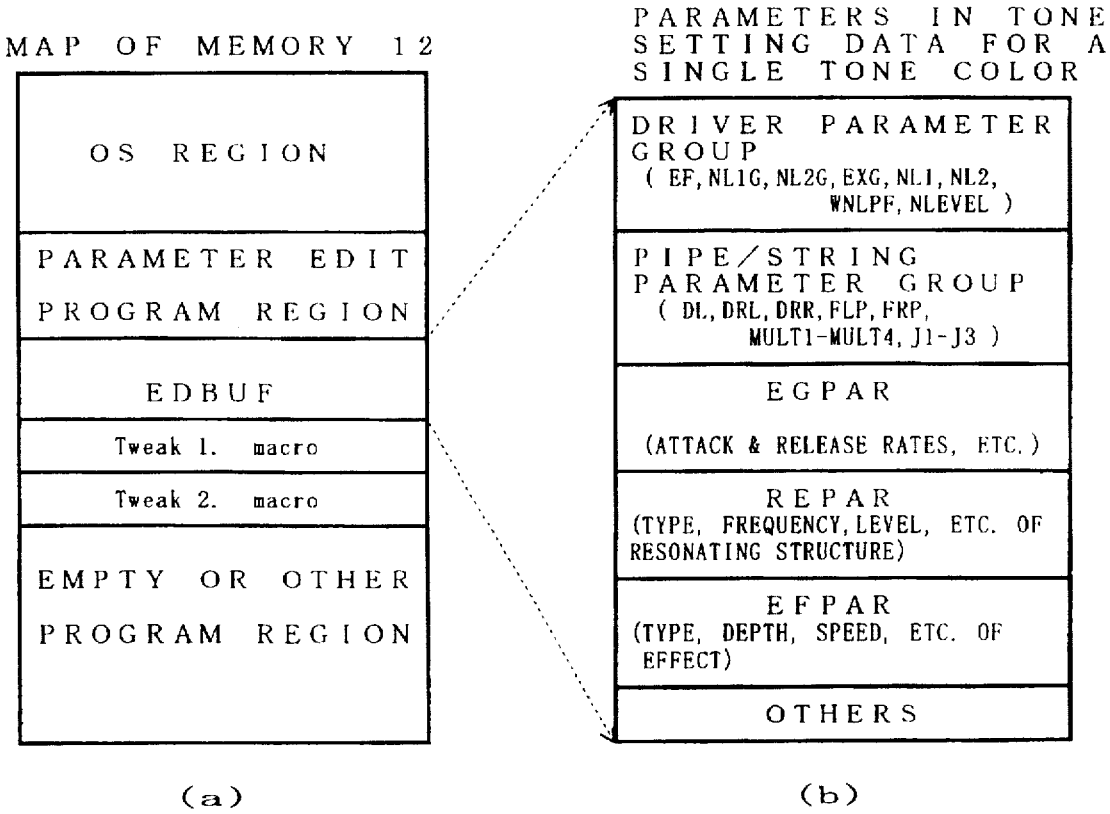
FIG. 6*a* and 6*b* are diagrams illustrating an example of a memory map in a parameter editor device of FIG. 1.

In FIG. 6, a left block denoted at (a) illustrates an example of a memory map in the memory 12 of the parameter editor device 10, and a "parameter edit program" for carrying out the present invention is stored in a predetermined region of the RAM 12. Another predetermined region of the memory 12 is reserved as an edit buffer EDBUF where a set of tone setting data for a specific tone color selectively retrieved from the hard disk device 13 in the above-mentioned manner is stored.

A right block denoted at (b) in FIG. 6 shows an exemplary format of a plurality of parameters included in the set of tone setting data for a specific tone color stored in the edit buffer EDBUF. Parameters collectively shown under the name of "drive parameter group" for convenience of illustration are those for use in the driver modelling section 30 of the DSP 25, and the detail of each of the parameters is as previously noted in relation to FIG. 3. Parameters collectively shown under the name of "pipe/string parameter group" for convenience of illustration are those for use in the pipe/string modelling section 40 of the DSP 25, and the detail of each of the parameters is as previously noted in relation to FIG. 4. As previously noted in relation to FIG. 2, each of the other parameter groups EGPAR, REPAR and EFPAR, includes a plurality of parameters for use in the envelope control section 50, resonating structure modelling section 60 and effect imparting section 70, and further includes various control parameters although not specifically shown in the figure.

Detailed examples of the functions, particularly "tone color selecting function" and "edit function", performed by the parameter editor device 10 will be described below, with reference to flowcharts of FIGS. 7 to 11 illustrating a detailed example of processing described by the parameter edit program.

Figure 7:
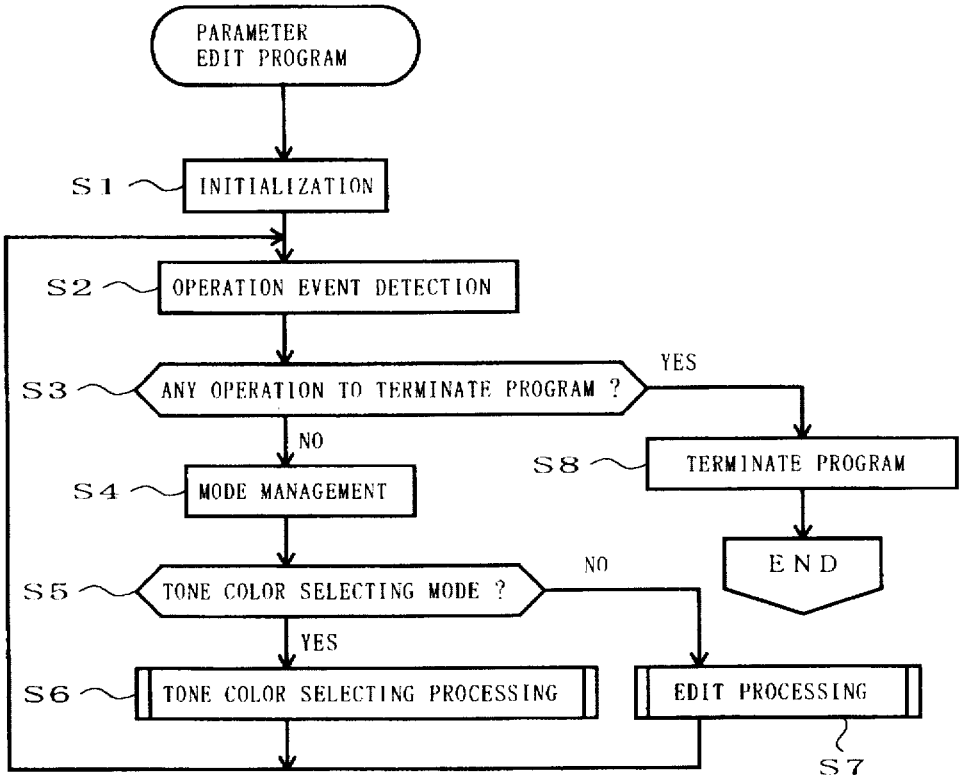
FIG. 7 is a flowchart illustrating an example of a main routine of a parameter edit program executed by the parameter editor device of FIG. 1.

FIG. 7 is a flowchart illustrating a main routine of the parameter edit program executed by the parameter editor device 10. Upon start of execution of this program, predetermined initialization is executed at step S1, and an operation event detecting operation is performed at step S2 to determine whether any operation event has occurred in the keyboard 15, mouse 16 and the like. The type of the event detected here is stored into a register so as to be referred to whenever necessary at subsequent determination steps.

At next step S3, a determination is made as to whether any operation has been performed to terminate the execution of the parameter edit program. If answered in the negative at step S3, the program goes to step S4, while if answered in the affirmative, it terminates the parameter edit program by way of step S8. Thus, the program goes to step S4 whenever the parameter edit program should continue to be executed.

At step S4, a mode management operation is performed to change an exhibited screen on the display 14 depending on a current edit operation mode; for example, at first, the display 14 is set to a tone color selecting screen.

Figure 12:
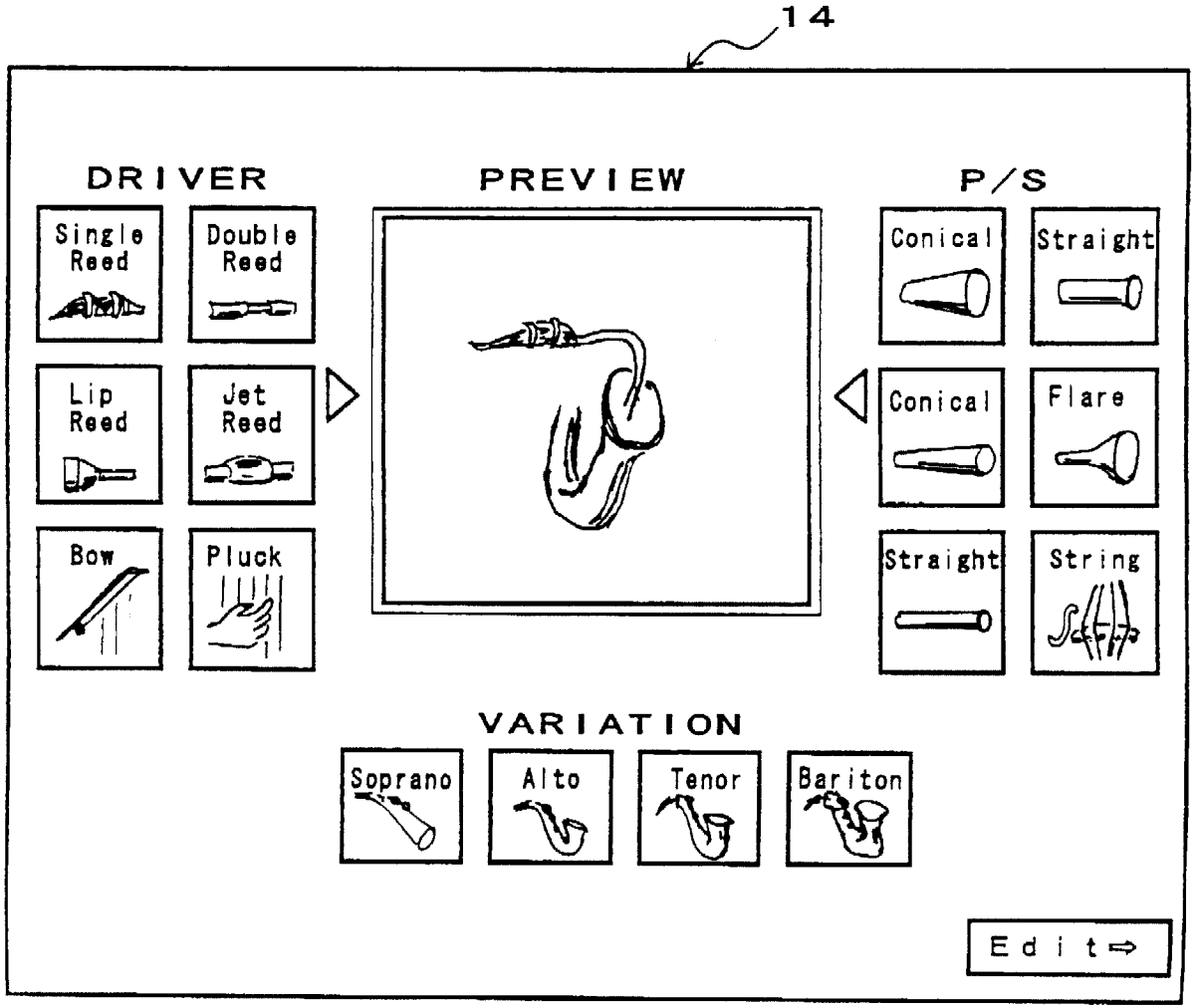
FIG. 12 is a diagram illustrating an example of a tone color selecting screen exhibited on a display of the parameter editor device of FIG. 1.

FIG. 12 is a diagram illustrating an example of the tone color selecting screen shown on the display 14. When the tone color selecting screen is exhibited on the display 14, various operations relating to the above-mentioned tone color selecting function are performed in tone color selecting processing at step S6, as will be described later.

At step S5, a determination is made as to whether a tone color selecting mode is currently ON. When the tone color selecting screen is exhibited on the display 14 as shown in FIG. 12, this means that tone color selecting mode is on, so that a "YES" determination results at step S5 and the program executes the tone color selecting processing at step S6.

Figure 8:
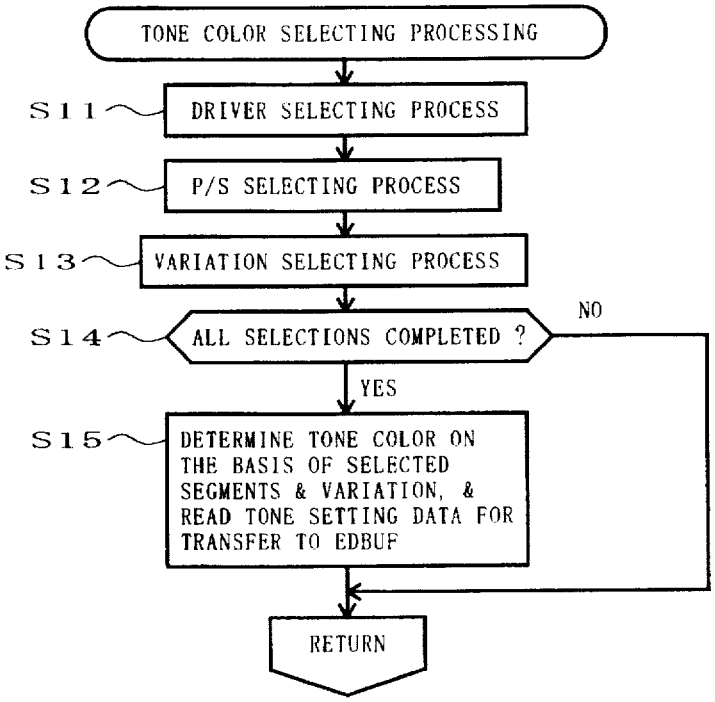
FIG. 8 is a flowchart illustrating an example of a tone color selecting process of FIG. 7.

In FIG. 8, there is illustrated an example of a programmed step sequence of the tone color selecting processing, which is intended for permitting a tone color selection by selecting in combination desired ones of the segments of the exciting mechanisms and structures of various musical instruments with reference to the tone color selecting screen as shown in FIG. 12. In the embodiment, the selectable segments of the exciting mechanisms and structures are displayed in two classified groups, one group relating to the exciting function and the other group relating to the resonating function, so that one segment can be selected from each of the groups to thereby provisionally select a single tone color based on a combination of the two selected segments.

On the tone color selecting screen of FIG. 12, respective visual information, in the form of guide letters and symbolic graphic representations, of six segments belonging to the exciting-function relating group is provided in an area labelled "DRIVER" for the user's selection. Namely, in correspondence to the segments relating to the exciting mechanisms, six options comprising "Single Reed" (reed segment of saxophone or clarinet), "Double Reed" (reed segment of oboe or bassoon)", "Lip Reed" (mouse piece segment of trumpet or horn), "Jet Reed" (non-reed mouthpiece segment of flute or fife), "Bow" (segment of an exciting mechanism implemented by rubbing a string with a bow) and "Pluck" (segment of an exciting mechanism implemented by plucking a string with a finger) are visually displayed in the "DRIVER" area.

On the tone color selecting screen of FIG. 12, respective visual information, in the form of guide letters and symbolic drawings, of six segments belonging to the resonating-function relating group is provided in an area labelled "P/S" (abbreviation of pipe/string). Namely, in correspondence to the segments relating to the resonating mechanisms, six options, thick "Conical" (segment of a thick conical pipe of saxophone or the like), thin "Conical" (segment of a thin conical pipe of oboe, bassoon or the like)", thin "Straight" (segment of a cylindrical pipe of clarinet or the like)", thick "Straight" (segment of a cylindrical pipe of flute or the like), "Flare" (funnel-shaped segment of a brass) and "string" (segment of a string) are visually displayed in the "P/S" area for the user's selection.

According to the selection based on the tone color selecting screen, one of the six segments in the DRIVER area and one of the six segments in the P/S area are selectively combined to provisionally select one of 36 tone colors.

Further, a visual representation of a combination of the selected segments (i.e., representation implying the provisionally selected tone color) is provided in an area labelled "PREVIEW" on the tone color selecting screen. FIG. 12 shows a situation where a tone color of saxophone is provisionally selected as a result of selection of the "Single Reed" and thick "Conical" options.

The actual selection in this case may be made by the user operating the mouse 16 to move a cursor (or pointer) to point to a desired one of the options on the display 14 and then conducting a predetermined single or double clicking action. Alternatively, the selection may be made by the user operating a cursor or function key on the keyboard 15. In the following description, various selecting, setting and adjusting operation using the display 14 are effected by the combined use of the cursor (or pointer) on the display 14 and mouse 16 or keyboard 15. Thus, operation of a sliding operator on the display 14 through a predetermined amount may be effected by drag and drop actions of the mouse 16.

Where a plurality of variations are preset for the tone color (i.e., provisional tone color) corresponding to the combination displayed in the PREVIEW area, an area labelled "VARIATION" on the screen of FIG. 12 provides visual information of these tone color variations in the form of letters and symbolic graphic representation. The example of FIG. 12 shows that as variations of a provisional saxophone tone color displayed in the PREVIEW area, "Soprano", "Alto", "Tenor" and "Bariton" are preset. The user performs operation to further select a tone color from among the displayed variations in the VARIATION area. In the event that no specific variation selection is made by the user, a predetermined one of the variations (e.g., leftmost variation) may be selected automatically. The number of such variations need not necessarily be four and may be different for each of the provisional tone colors (i.e., for each of the 36 combinations). In this example, it is assumed that the maximum number of selectable variations is "eight" for some particular combinations, i.e., provisional tone colors. Of course, there may be some provisional tone colors which have no variation at all, in which case a tone color corresponding to the combination displayed in the PREVIEW area is selected directly and no visual information is provided in the VARIATION area.

Referring to FIG. 8, a driver selecting process is executed at step S11, where it is determined, on the basis of the result of the operation event detection of step S2, whether operation has been performed to select any one of the six segments (i.e., options) displayed in the DRIVER area of FIG. 12. If such operation has been performed as determined at step S11, data indicative of the selected segment or option is stored into a predetermined register. In this case, the selected segment may be displayed in the PREVIEW area.

At next step S12, a P/S selecting process is executed at step S12, where it is determined, on the basis of the result of the operation event detection of step S2, whether operation has been performed to select any one of the six segments (i.e., options) displayed in the P/S area of FIG. 12. If such operation has been performed as determined at step S12, data indicative of the selected segment or option is stored into a predetermined register. In this case, the selected segment may be displayed in the PREVIEW area.

A variation selecting process is executed at next step S13. Namely, if one or more variation tone colors are being displayed in the VARIATION area of FIG. 12, it is determined, on the basis of the result of the operation event detection of step S2, whether operation has been performed to select any one of the variation tone colors. If such operation has been performed, data indicative of the selected segment is stored into a predetermined register.

After that, a determination is made at step S14 as to whether all the necessary selections have been completed or not. Namely, this step examines, by reference to the data registered at steps S11 and S12, whether desired selections have been completed in both the DRIVER area and the P/S area, and also examines, by reference to the data registered at step S13, whether a variation tone color selection has been completed if the tone color in question has one or more variation.

If answered in the negative at step S14, the program returns from the flow of FIG. 8 to the main flow of FIG. 7 in order to repeat the operations of steps S2 to S6. If, on the other hand, all the necessary selections have been completed, this means that it is now possible to specify a single tone color, and thus an affirmative determination results at step S14, so that the program proceeds to step S15. At step S15, a single selected tone color is determined on the basis of the combination of the selected two segments and the selected variation (if any), and a set of tone setting data corresponding to the tone color is read out from the data base (hard disk device 13) and loaded into the edit buffer EDBUF of the memory 12. At this time, the set of tone setting data corresponding to the selected tone color may also be transferred via the data interfaces 17 and 18 to the tone generator device, i.e., DSP 25. Alternatively, the tone setting data transfer to the DSP 25 may be conducted on another occasion. After step S14, the program returns to the main routine in order to repeat the operations of steps S2 to S6.

Figure 13:
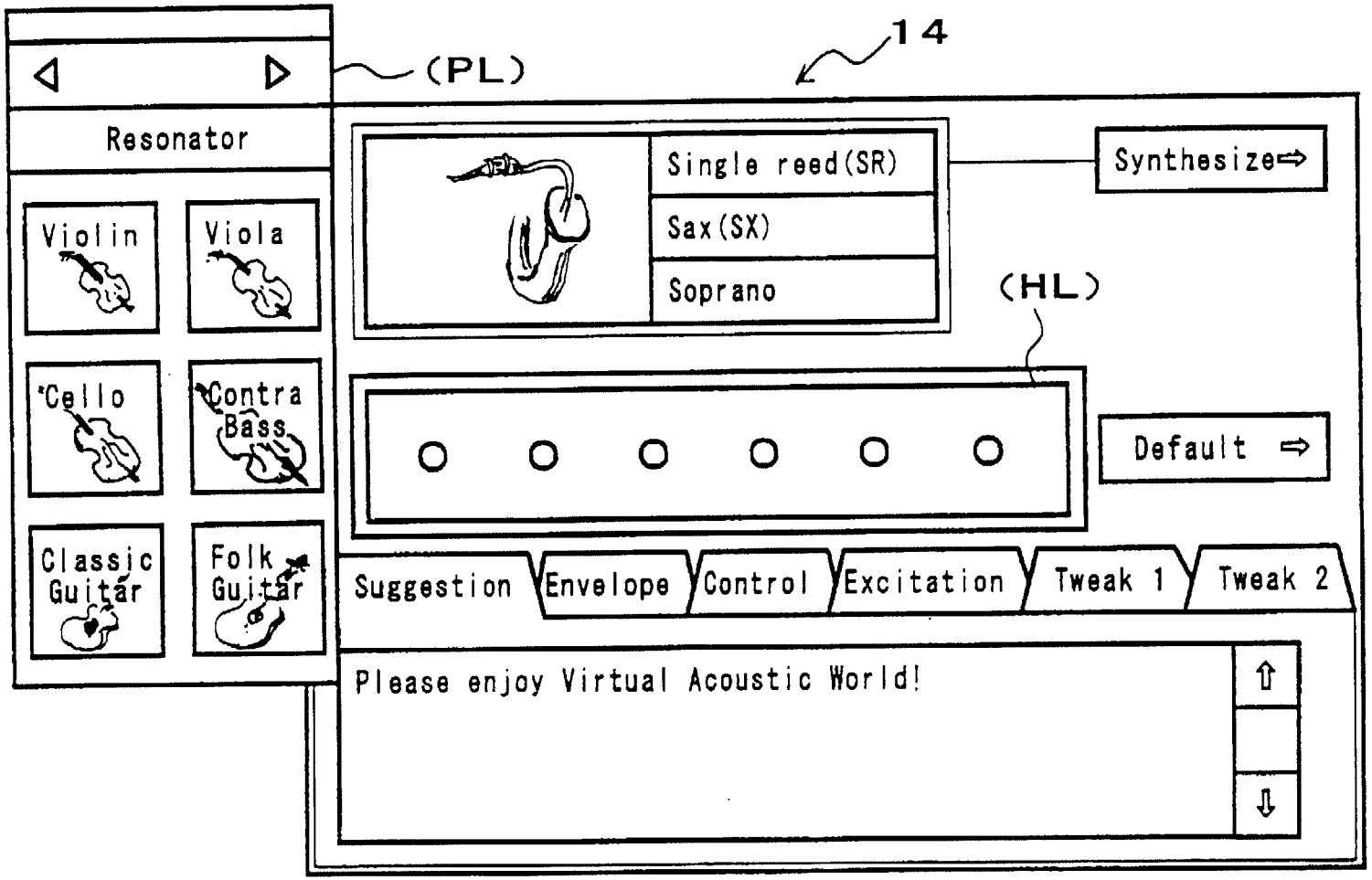
FIG. 13 is a diagram illustrating an example of an edit screen exhibited on the display of the parameter editor device of FIG. 1.

To terminate the tone selecting mode, the user may selectively activate an "Edit" key displayed at the lower right corner of the screen of FIG. 12 (i.e., move the cursor to point to the Edit key and click the mouse 16). In response to the Edit key activation, the mode management operation changes the screen on the display 14 to an edit screen as shown in FIG. 13. Then, it is determined at next step S5 that the tone color selecting mode is not currently ON, so that the program goes to edit processing of step S7 in order to perform various operations relating to the above-mentioned edit function.

Figure 9:
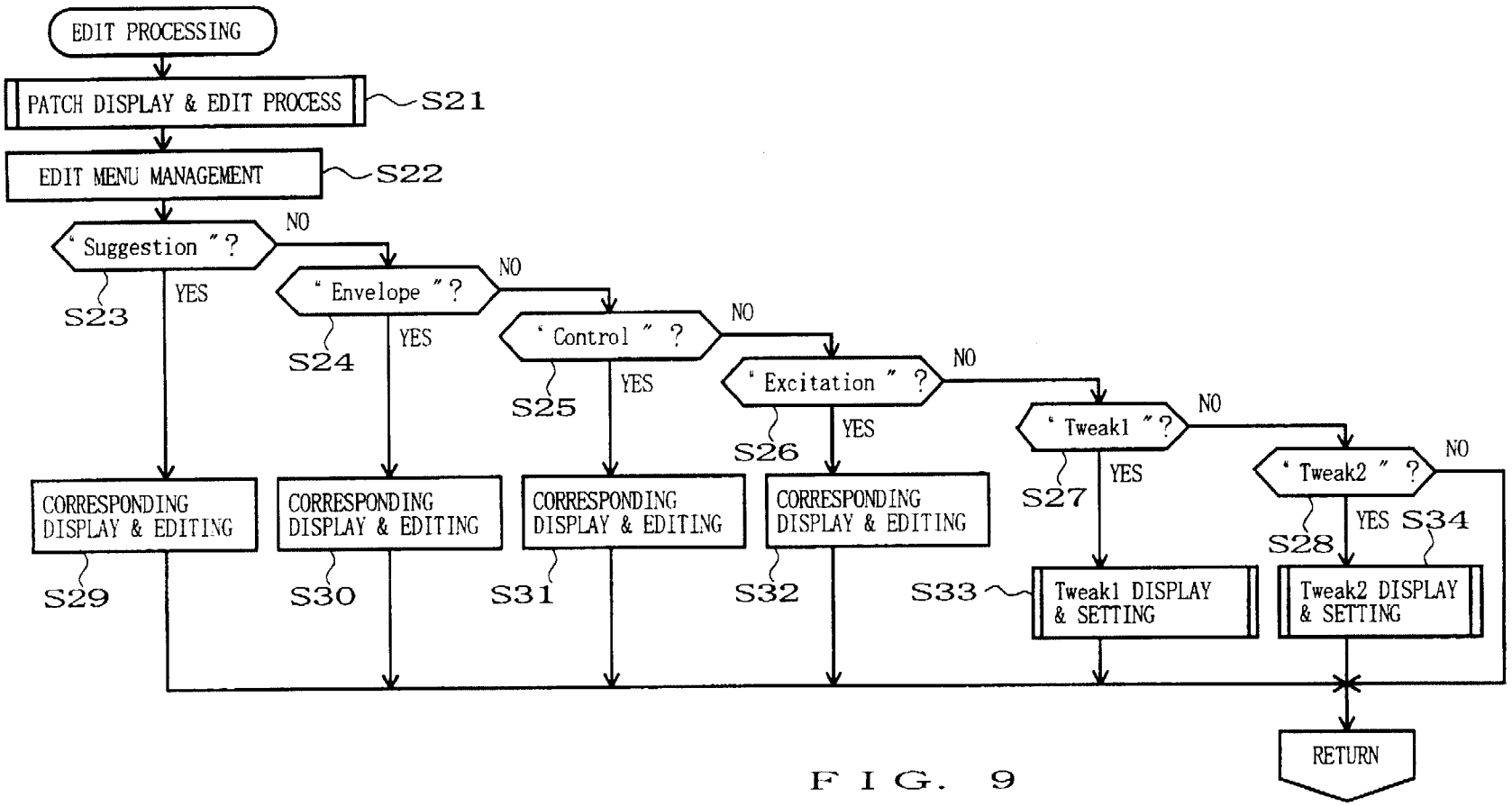
FIG. 9 is a flowchart illustrating an example of edit processing of FIG. 7.

In FIG. 9, there is illustrated an example of a programmed step sequence of the edit processing, which is intended for ad adjusting or changing a parameter value included in the set of tone setting data stored in the edit buffer EDBUF. Specifically, this edit processing provides two types of parameter edit processing, one of which is performed on a patch-by-patch basis and the other of which is performed in accordance with a selected edit menu.

In FIG. 9, a patch display and edit process is performed at step S21. In the patch display and edit process, each predetermined plurality of parameters in the set of tone setting data stored in the edit buffer EDBUF is treated as a patch and operations to select or change the parameters are performed on a patch-by-patch basis, as will be later described in detail with reference to FIG. 10.

At next step S22, an edit menu management operation is performed to manage the edit menu exhibition on the display 14 depending on the result of the operation event detection of step S2. Specifically, when operation has been performed to select an edit menu, the edit menu exhibition is changed to allow the selected new menu page to appear on the screen.

This feature will be further described reference to FIGS. 13 to 17. In FIG. 13, "Suggestion", "Envelope", "Control", "Excitation", "Tweak 1" and "Tweak 2" displayed horizontally in a lower area of the screen are indices to edit menu pages. Operation to select a desired one of the displayed indices can select a desired edit menu and allows the currently selected edit menu page (or edit menu card) to appear on the screen. For example, FIG. 13 shows a state where the "Suggestion" menu is selected, FIG. 14 a state where the "Envelope" menu is selected, FIG. 15 a state where the "Control" menu is selected, and FIGS. 16 and 17 a state where the "Tweak 1" menu is selected.

At following steps S23, S24, S25, S26, S27 and S28, it is determined which of the above-mentioned menus is currently selected, and the program branches to any one of steps for performing a display and edit operation or display and setting operation corresponding to the currently selected edit menu (i.e., any one of steps S29 to S34).

If the "Suggestion" menu is currently selected as determined at step S23, the program proceeds to step S29 to display an appropriate message as shown in FIG. 13. Roll-up and roll-down keys are also displayed to permit upward or downward rolling of the message lines if the message amounts to a considerable volume.

Figure 14:
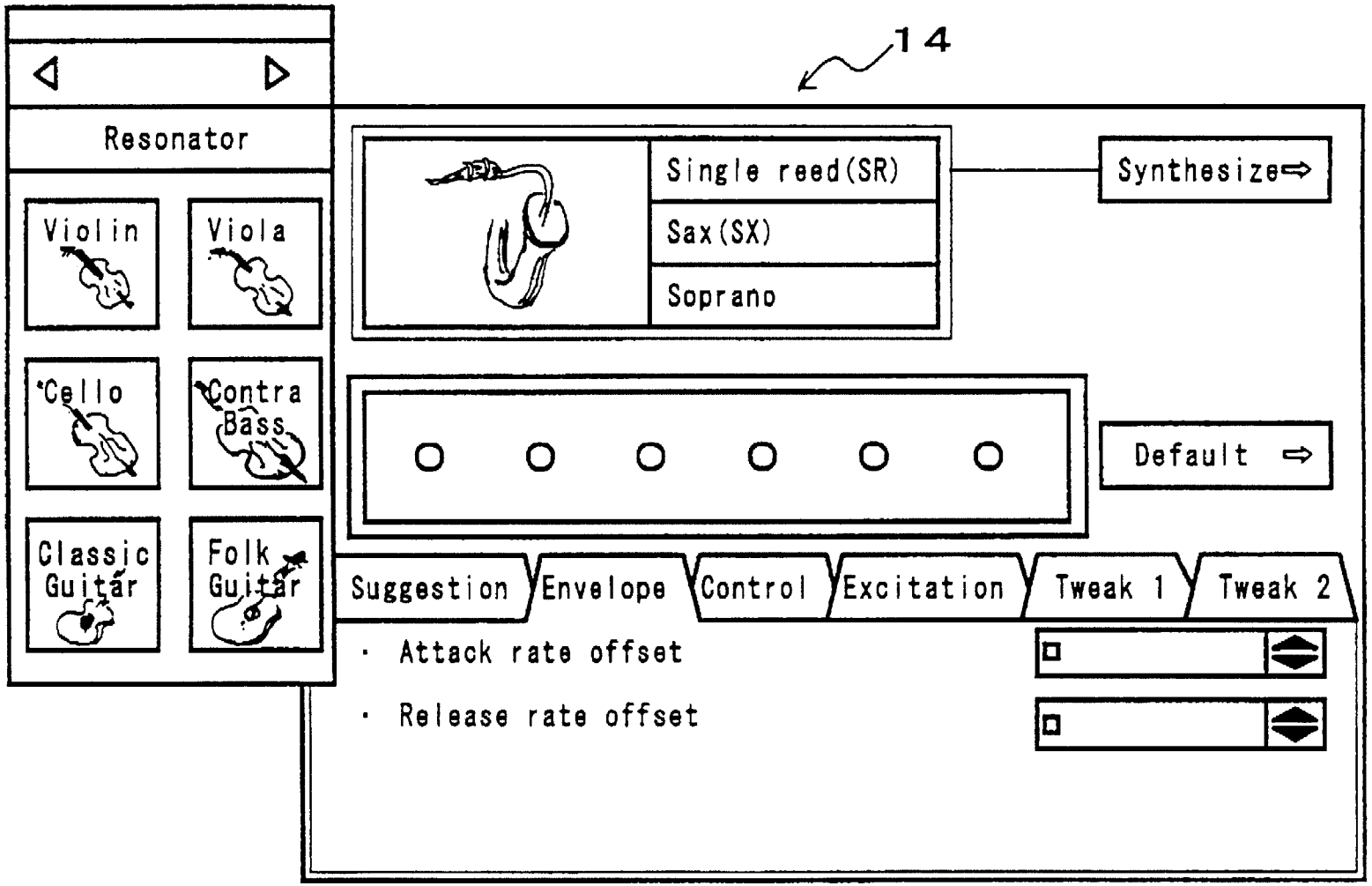
FIG. 14 is a diagram illustrating another example of the edit screen exhibited on the display of the parameter editor device of FIG. 1.

If the "Envelope" menu is currently selected as determined at step S24, the program proceeds to step S30 to display various envelope parameters included in the envelope parameter group EGPAR along with necessary operators as shown in FIG. 14, so that a value of a desired one of the parameters is set or changed in response to a user's operation of the corresponding operator.

Figure 15:
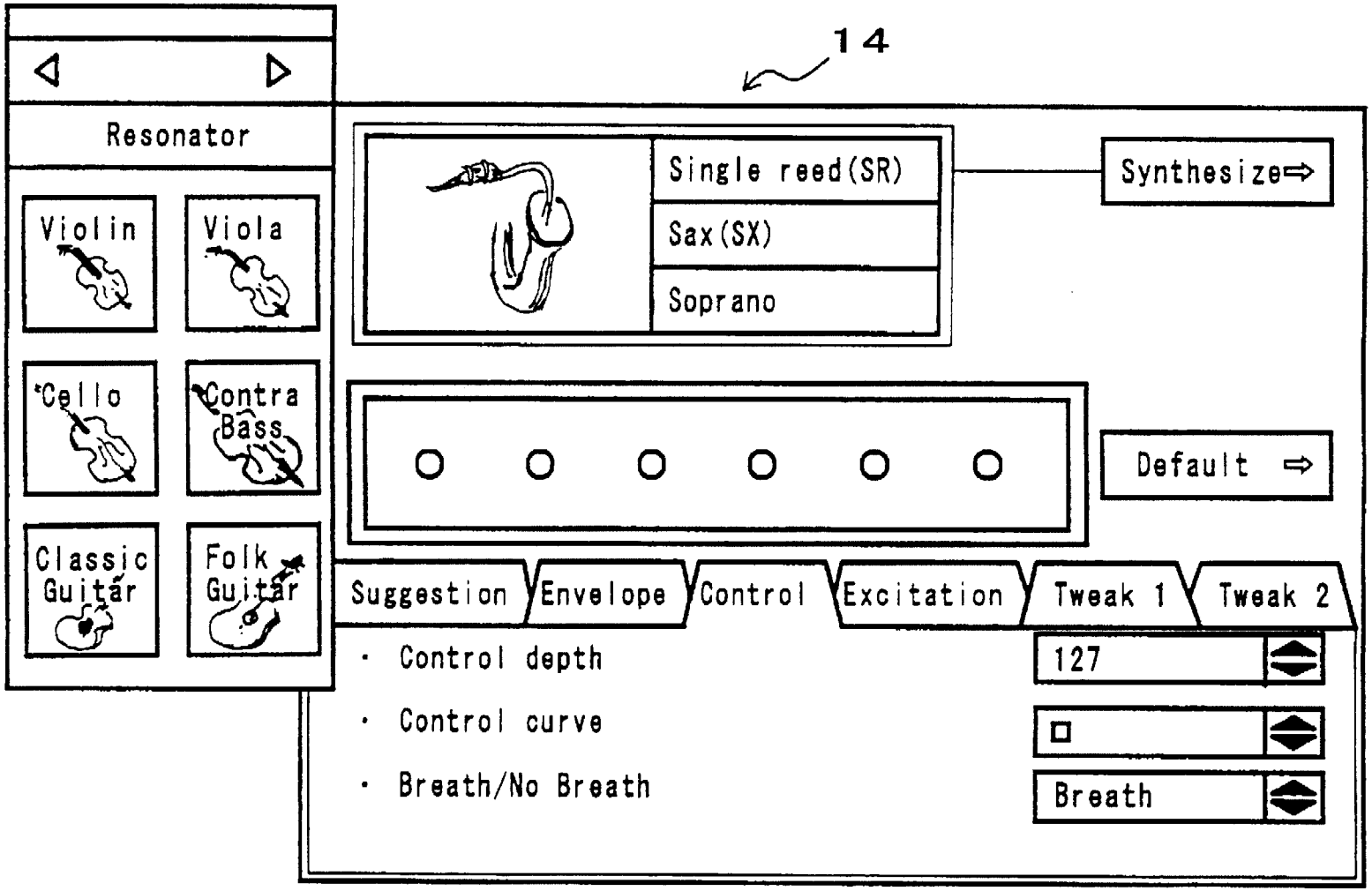
FIG. 15 is a diagram illustrating still another example of the edit screen exhibited on the display of the parameter editor device of FIG. 1.

If the "Control" menu is currently selected as determined at step S25, the program proceeds to step S31 to display various control parameters along with necessary operators as shown in FIG. 15, so that a value of a desired one of the control parameters is set or changed in response to a user's operation of the corresponding operator. The control parameters to be edited here include parameters for controlling values of the above-mentioned pressure signal P and embouchure signal E to be used in the DSP 25 and parameters for indirectly controlling various parameters, coefficients and selection signals to be used in the DSP 25.

In the case where the performance operating section 23 in the body of the electronic musical instrument includes a breath-pressure-type performance operating device such as a breath controller, depending on a type of the tone color, tone volume amplitude control signals and various destinations such as filter parameter EF for the exciting section filter 32 may be simultaneously controlled as well as the pressure signal P and embouchure signal E on the basis of an output signal of the breath controller. With such a tone color, it may become necessary to change all settings for a plurality of destinations if the control signal used is switched from the breath controller output signal to a key-on velocity signal or the like. Of the control parameters shown in FIG. 15, "Breadth/No Breath" is a control parameter for changing the control form one form using the breath controller output signal to another form using another signal (e.g., key-on velocity signal) or vice versa. When the control form is to be changed, the source of the control signal is switched, collectively for a plurality of destinations, from the breath controller output signal to the key-on velocity signal or the like or from the key-on velocity signal or the like to the breath controller output signal.

Of the control parameters shown in FIG. 15, "Control depth" is a control parameter for controlling a depth of the control signal for each of the destinations where it is instructed that the breath controller output signal should be used as the source of the control signal. Further, "Control curve" is a control parameter for controlling a change characteristic curve of the control signal for each of the destinations where it is instructed that the breath controller output signal should be used as the source of the control signal.

If the "Excitation" menu is currently selected as determined at step S26, the program proceeds to step S32 to display various control parameters relating to the menu along with necessary operators, so that a value of a desired one of the control parameters is set or changed in response to a user's operation of the corresponding operator. The control parameters to be edited here are the various parameters to be used in the DSP 25, and in this "Excitation" menu, values of these various parameters are adjusted or changed directly.

Figure 16:
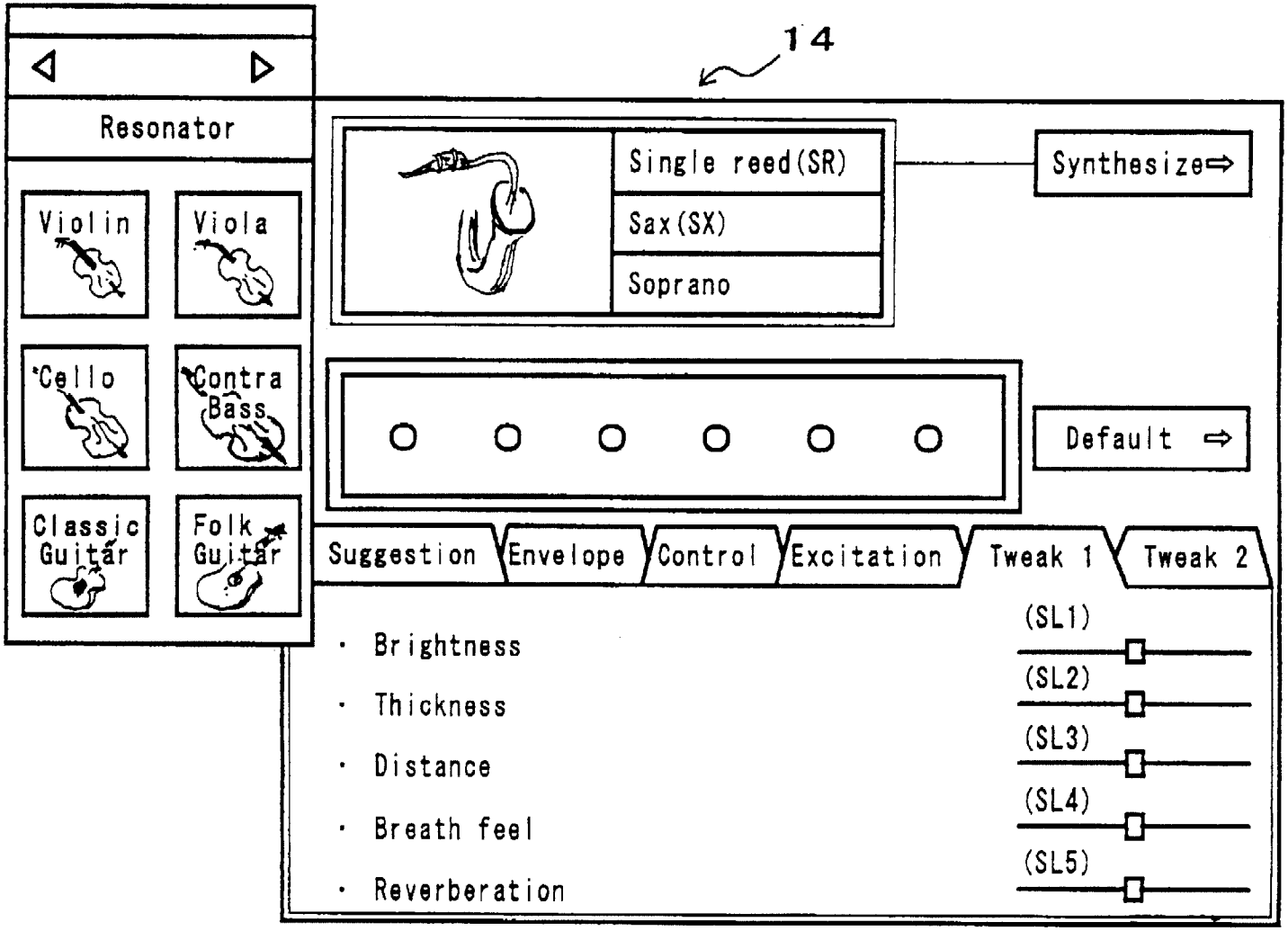
FIG. 16 is a diagram illustrating yet another example of the edit screen exhibited on the display of the parameter editor device of FIG. 1.

If the "Tweak 1" menu is currently selected as determined at step S27, the program proceeds to step S33 in order to perform a Tweak 1 display and setting process. An exemplary screen of the "Tweak 1" menu is as shown in FIG. 16, where sliding operators (virtual operators) SL1 to SL5 are displayed in corresponding relations to, rather than individual parameters, individual sensuous factors that are called "sensuous tonal characteristic factors" for convenience of description. The respective names of the sensuous tonal characteristic factors are also displayed in the "Tweak 1" menu. Thus, in response to operation of a specific one of the sliding operators, the "Tweak 1" menu is used to adjust, set or change parameter values for the corresponding sensuous tonal characteristic factor. Specifically, at least two parameters are designated for each of the sliding operators corresponding to the sensuous tonal characteristic factors so that values of the at least two parameters are variably controlled or adjusted in response to operation of just one of the sliding operators.

In the illustrated example of FIG. 16, the sensuous tonal characteristic factors are named "Brightness", "Thickness", "Distance", "Breath feel" and "Reverberation", which correspond to human being's feelings about "brightness of a tone color", "thickness of a tone color", "distance", "breath" and "reverberation". Because it is difficult or undesirable to associate such human being's feeling is to the individual parameters on a one-to-one basis, this edit menu is designed to achieve control and adjustment of parameters exactly according with human being's feelings and facilitate the user's necessary operation, by associating the operators with the sensuous tonal characteristic factors on a one-to-one basis and also collectively designating at least two parameters for each of the operators to control the corresponding characteristic factor so that the at least two parameters are variably adjusted together in response to the user's operation of a specific one of the operators. As will be later described, an amount of parameter-based control or change responsive to a predetermined operation amount of the corresponding operator are set separately for each of the parameters, so that the amount of control or change can be set to an optimal value independently for each of the parameters although the parameters are designated together.

Figure 11:
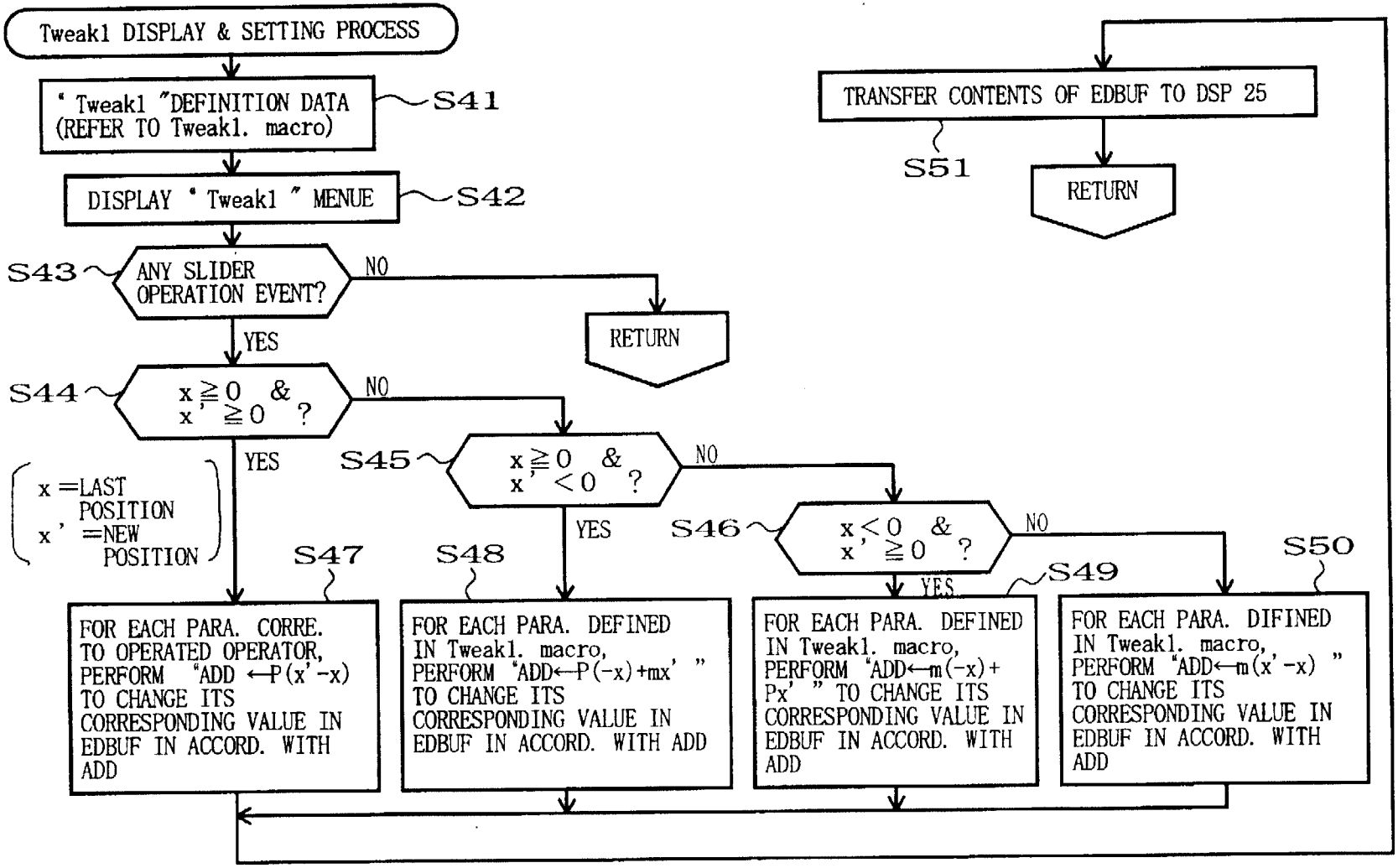
FIG. 11 is a flowchart illustrating an example of a Tweak 1 display and setting process of FIG. 9.

FIG. 11 illustrates an example of a programmed step sequence of the "Tweak 1 display and setting process" that is performed at step S33 FIG. 9. If the "Tweak 2" menu is currently selected as determined at step S28, the program proceeds to step S34 of FIG. 9 in order to perform a Tweak 2 display and setting process. Only operations corresponding to the "Tweak 1" menu will be described in detail below since operations corresponding to the "Tweak 1" and "Tweak 2" menus are substantially similar to each other.

FIGS. 18A to 18D show by way of example ranges over which each of the sliding operators SL1–SL5 used in the "Tweak 1" menu is operated to move. As shown, when each of the sliding operators SL1–SL5 is at a predetermined center point, operational position data of "0" is obtained. A positive (plus) region is to the right of the center point and the right-most position in the region represents "+16", while a negative (minus) region is to the left of the center point and the left-most position in the region represents "−16". Thus, the operational position data directly obtained in response to the movement of the sliding operator SL1, SL5 is negative- or positive-value data ranging from −16 to +16. However, a data change amount or coefficient of the parameter corresponding to the predetermined operation amount of the sliding operator is set separately for each of the positive and negative regions as well as for each of the parameters. Thus, even with a same operation amount, different level of effect (degree of adjustment) provided by the operation can be set for each of the parameters, so that different proper adjustment can be effected for each of the parameters while processes exactly according with the user's feeling are performed by the user's same operation. Also, by differentiating the level of effect (degree of adjustment) to be achieved by the same operator position between the parameters, even more proper adjustment can be obtained for each of the parameters by the user working the same operator.

The following are examples of the two parameters (parameter 1 and parameter 2) designated for (or allocated to) each of the sliding operators SL1–SL5 and values of positive and negative region coefficients p and m set for parameter 1 and parameter 2.

(Example 1)
Operator SL1 : "Brightness"
Parameter 1=FREQ; p=3, m=1
Parameter 2=FRP; p=2, m=2
(Example 2)
Operator SL2: "Thickness"
Parameter 1=DEPTH; p=1, m=1
Parameter 2=FREQ; p=1, m=2
(Example 3)
Operator SL4: "Breath feel"
Parameter 1=NLEVEL; p=3, m=1
Parameter 2=WNLPF; p=1.5, m=1.5

In the examples above, parameter FREQ is a resonator-frequency-characteristic setting parameter included in the parameter group REPAR for controlling the resonating structure modelling section 60. Parameter DEPTH is an effect-depth setting parameter included in the parameter group EFPAR for controlling the effect imparting section 70. Other parameters FRP, NLEVEL and WNLPF are parameters for controlling the driver modelling section 30 of FIG. 3 or pipe/string modelling section 40 of FIG. 4 as previously explained.

Explaining Example 1 above, two parameters FREQ and FRP are allocated to the sliding operator SL1 corresponding to "Brightness", the positive and negative region coefficients p and m for the FREQ parameter is "3" and "1", respectively, and the positive and negative region coefficients p and m for the FRP parameter is "2" and "2", respectively.

As seen from Example 1 and Example 2 above, same parameter FREQ may be designated for different operators SL1 and SL 2 (namely, different sensuous tonal characteristic factors "Brightness" and "Thickness"), but different values of the coefficients p and m are set separately for the operators SL1 and SL2. If the sliding operator SL1 is operated by an appropriate amount to adjust parameters PREQ and FRP and then the sliding operator SL2 is operated by an appropriate amount to adjust parameters DEPTH and FREQ, parameter FREQ will be influenced by the operation of the two operators SL1 and SL2 so as to be adjusted sequentially in order of the operator operation.

The definition illustrated in Example 1 to Example 3 is given in "Tweak 1. macro" in the memory 12 as for the sliding operators SL1–SL5 used in the "Tweak 1" menu and given in "Tweak 2. macro" in the memory 12 as for the sliding operators SL1–SL5 used in the "Tweak 2" menu. In each of Tweak 1. macro and Tweak 2. macro, a title representative of a sensuous tonal characteristic factor such as "Brightness" may be variably defined in addition to the sorts of the parameters and values of the coefficients p and m corresponding to the operators.

Figure 18A:
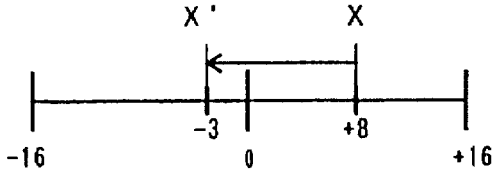
FIGS. 18A to 18D are diagram explaining exemplary operation of a sliding operator which is used in a Tweak 1 menu displayed in the edit screen of FIG. 16.

With reference to FIG. 18A, an example of parameter adjusting arithmetic will be described in relation to one of the sliding operators (in the example, operator SL1) . Assume that the sliding operator SL1 has been operated to move or slide leftward from a position x (=+8) to a new position X' (=–3). In this case, as for one of the parameters FREQ allocated to the operator SL1, the amount of change in the positive region is –8 because the movement in the negative direction is over an amount of 8 and the change amount –8 is then multiplied by positive region coefficient p=3 to get a value of –24; the amount of change in the negative region is –3 because it is negative from the beginning and the change amount –3 is then multiplied by negative region, coefficient m=1 to get a value of –3. After that, the two values are added together (–24+(–3)) to get a value of –27, which is determined as a data change amount (corresponding to a later-described amount "ADD") for the FREQ parameter. Thus, adjustment is effected by adding the value "–27 " to the current value of the FREQ parameter. As for the other parameter FRP allocated to the operator SL1, the change amount –8 in the positive region is multiplied by positive region coefficient p=2 to get a value of –16; the change amount –3 in the negative region is multiplied by negative region coefficient m=2 to get a value of –6. After that, the two values are added together (–16+(–6)) to get a value of –22, which is determined as a data change amount (corresponding to the later-described amount "ADD") for the FRP parameter. Thus, adjustment is effected by adding the value "–22" to the current value of the FRP parameter.

In the "Tweak 1 display and setting process" shown in FIG. 11, parameter adjusting arithmetic operations as outlined above are performed in response to user's operation of any of the sliding operators SL1 to SL5.

In FIG. 11, at step S41, definition data about the sliding operators in the "Tweak 1" menu are obtained with reference to the above-mentioned Tweak 1. macro. At next step S42, management is conducted, on the basis of the definition data, to display the "Tweak 1" menu screen as shown in FIG. 16.

Then, at step S43, a determination is made as to whether or not any of the sliding operators SL1 to SL5 has been operated on the "Tweak 1" menu screen. If answered in the negative, the program returns to the main routine, but if any of the sliding operators SL1 to SL5 has been operated, it is further determined at any one of steps S44, S45 and S46 what type of a sliding operation event has occurred in the operator.

Figure 18B:
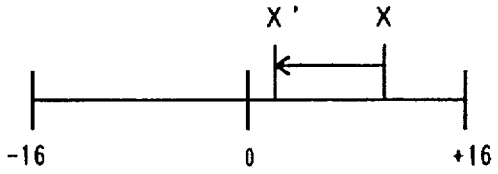

At step S44, it is examined whether x≧0 and x'≧0 are satisfied, where "x" represents a last operational position of the operator in which the sliding operation event has occurred (i.e., position before the operation event) and "x'" represents a new operational position taken by the operator as a result of the operation event. This condition "x≧0 and x'≧0" signifies that the sliding operator has been moved in the negative or positive direction within the positive region as shown in FIG. 18B. If x≧0 and x'≧0 are satisfied as determined at step S44, the program proceeds to step S47, where with reference to the above-mentioned definition in Tweak 1. macro, an arithmetic operation of "ADD ←p(x'–x)" is performed for each of the parameters allocated to the operated sliding operator so as to obtain a data change amount ADD for the parameter. Namely, the data change amount ADD is calculated by multiplying the difference between the latest and new positions (x'–x) by positive region coefficient p. In this case, negative region coefficient m is not used because the sliding movement of the operator is just within the positive region. Then, the thus-calculated data change amount ADD of each of the parameters corresponding to the operated sliding operator is added to the current value of the corresponding parameter stored in the edit buffer EDBUF, to thereby change its value. The parameter value may of course be changed by performing any other arithmetic, such as subtraction or multiplication, using the data change amount ADD, than adding the data change amount ADD as mentioned above.

At step S45, it is examined whether x≧0 and x'<0 are satisfied. This condition "x≧0 and x'<0" signifies that the sliding operator has been moved in the negative direction from the positive region to the negative region as shown in FIG. 18A. If x≧0 and x'<0 are satisfied as determined at step S45, the program proceeds to step S48, where with reference to the above-mentioned definition in Tweak 1. macro, an arithmetic operation of "ADD←p(–x)+mx'" is performed for each of the parameters allocated to the operated sliding operator so as to obtain a data change amount ADD for the parameter. The meaning of this arithmetic operation is just as described above in relation to step S47. As at step S47, the thus-calculated data change amount ADD is used to change the value of the corresponding parameter stored in the edit buffer EDBUF.

Figure 18C:
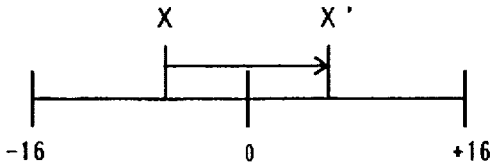
Figure 18D:
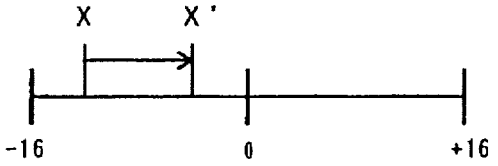

At step S46, it is examined whether x<0 and x'≧0 are satisfied. This condition "x<0 and x'≧" signifies that the sliding operator has been moved in the positive direction from the negative region to the positive region as shown in FIG. 18C. If x<0 and x'≧0 are satisfied as determined at step S46, the program proceeds to step S49, where with reference to the above-mentioned definition in Tweak 1. macro, an arithmetic operation of "ADD←m(–x) +px'" is performed for each of the parameters allocated to the operated sliding operator so as to obtain a data change amount ADD for the parameter. The meaning of this arithmetic operation may be readily understood because it is similar to the above-mentioned except that the coefficients p and m are reversed in position. As at step S47, the thus-calculated data change amount ADD is used to change the value of the corresponding parameter stored in the edit buffer EDBUF.

If a negative determination results at each of steps S44, S45 and S46, this means a condition x<0 and x'<0, i.e., that the sliding operator has been moved in the negative or positive direction within the negative region. In this case, the program proceeds to step S50, where with reference to the above-mentioned definition in Tweak 1. macro, an arithmetic operation of "ADD←m(x'–x)" is performed for each of the parameters allocated to the operated sliding operator so as to obtain a data change amount ADD for the parameter. The meaning of this arithmetic operation may be readily understood because it is similar to the arithmetic operation of step S47 except that the coefficients p and m are reversed in position. As at step S47, the thus-calculated data change amount ADD is used to change the value of the corresponding parameter stored in the edit buffer EDBUF.

Finally, at step S51, the stored contents of the edit buffer EDBUF having undergone the above-described parameter edit process are transferred via the data interfaces 17 and 28 to the DSP 25.

Figure 17:
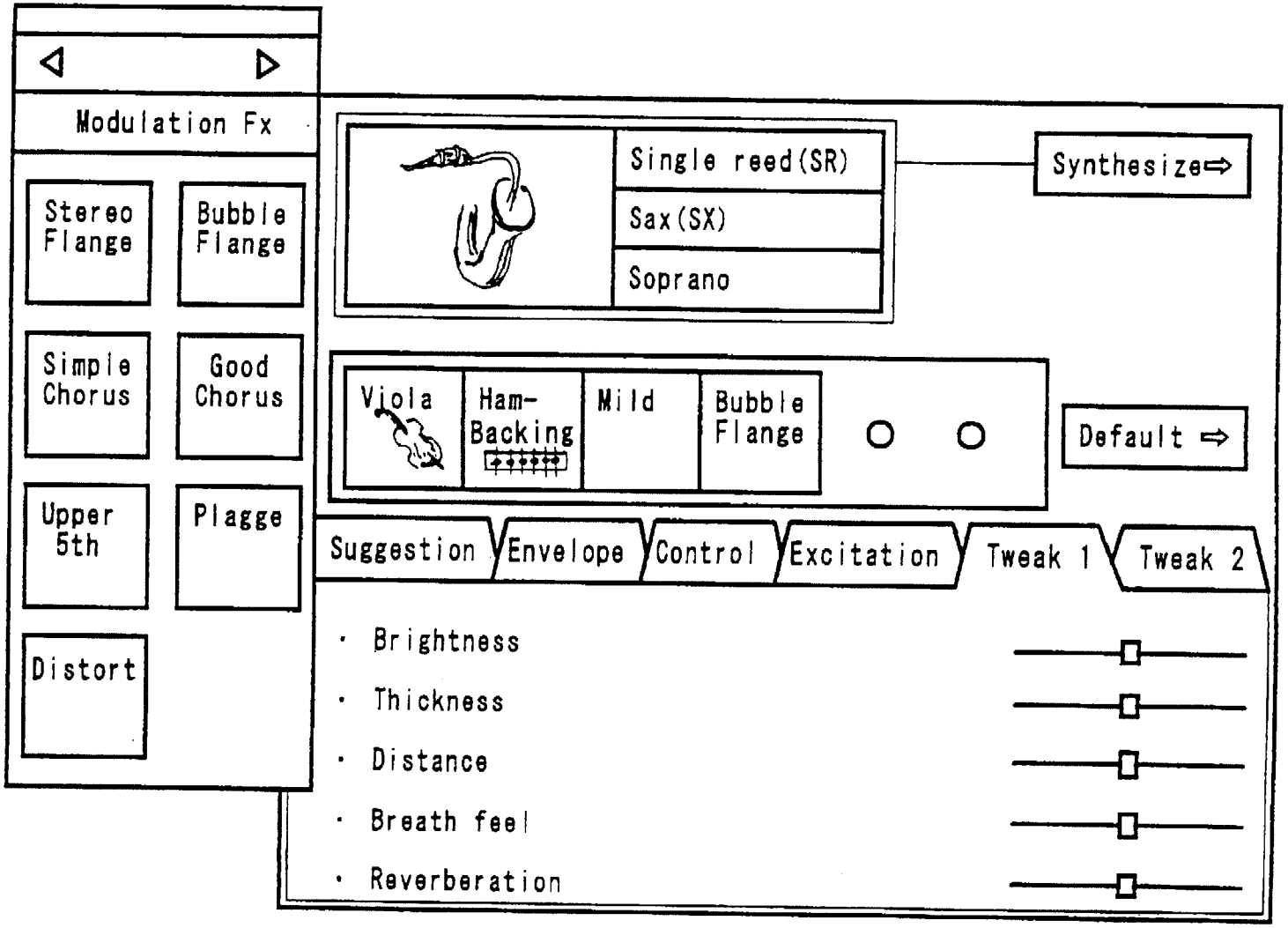
FIG. 17 is a diagram illustrating yet another example of the edit screen exhibited on the display of the parameter editor device of FIG. 1.

Next, a description will be made about the patch display and edit process with reference to FIG. 10, where an operation is performed at step S61 to exhibit a predetermined patch edit screen on the display 14 for execution of the patch display and edit process. The patch edit screen is exhibited on the display 14 in FIGS. 13 to 17. As shown in FIG. 13, for example, the patch edit screen includes a pallet portion PL provided on the left of the display 14 and a holder portion HL provided practically in the middle of the display 14. In the pallet portion PL, a plurality of patches are displayed so that a desired one of the patches is selected through drag and drop actions of the mouse 16, and the selected patch is then set in the holder portion HL to complete a desired patch selection (patch pasting). In each of the illustrated examples of FIGS. 13 to 16, no patch is selected and thus the holder portion HL is in an empty state. In FIG. 17, however, several patches are selected and set in the holder portion HL. The pallet portion includes a plurality of pages such as "Resonator", "Effects" (general acoustic effects), "Modulation Ex" (modulation effect) and "Equalizer" (tone color equalizer), so that the pallet of a desired one of the pages is exhibited in the pallet portion PL by operating an increment/decrement key displayed above the pallet portion PL. At step S62 of FIG. 10, a pallet selection and display operation is performed for the above-mentioned purpose.

For example, the "Resonator" pallet is one for selecting a type of the resonating structure to be used in the modelling section 60, and in this pallet, names of various stringed instruments are displayed as selectable patches. These patches comprise groups of parameters for implementing the respective resonators formed by the body of the individual stringed instruments.

Figure 10:
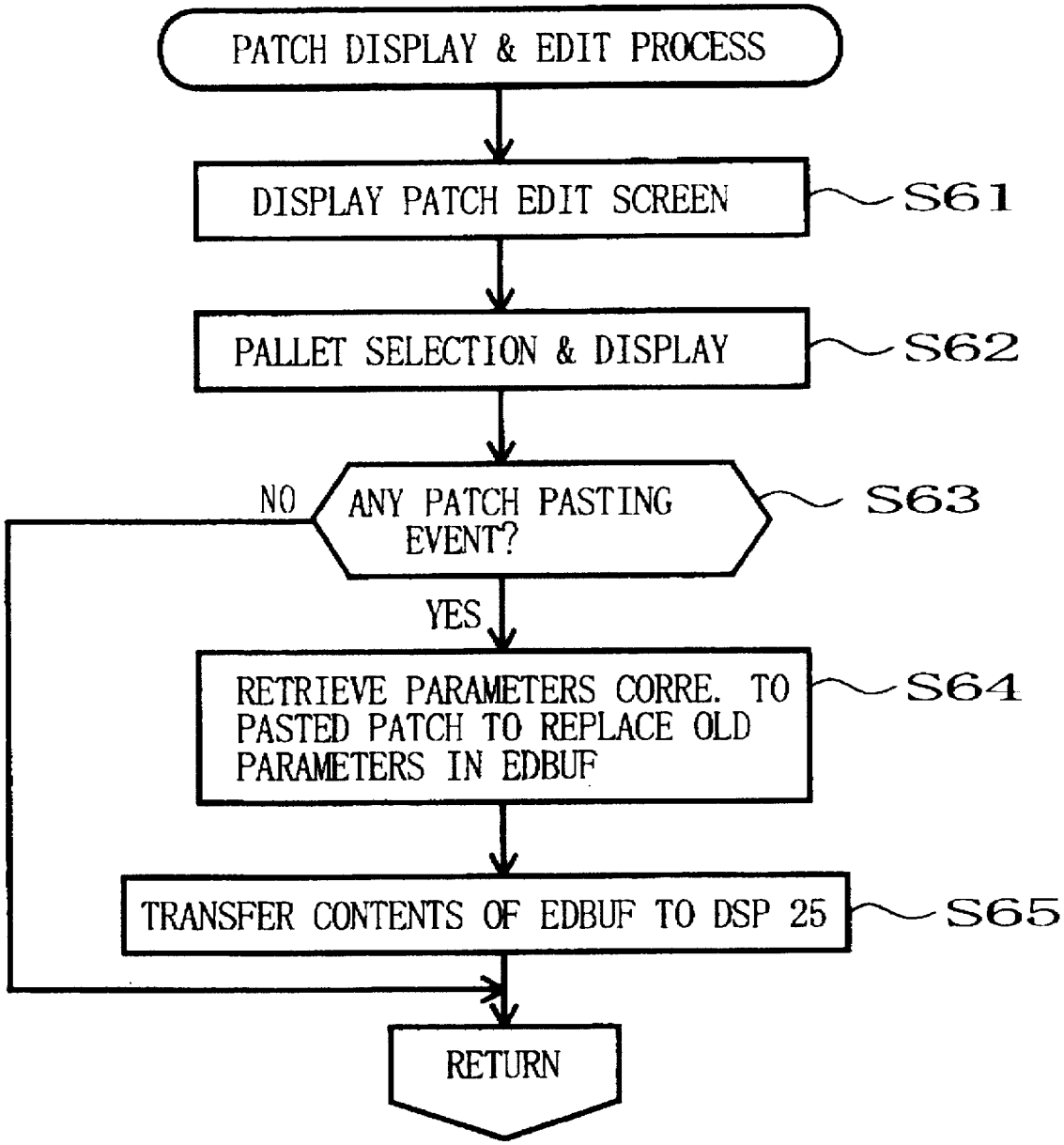
FIG. 10 is a flowchart illustrating an example of a patch display and edit process of FIG. 9.
Figure 19:
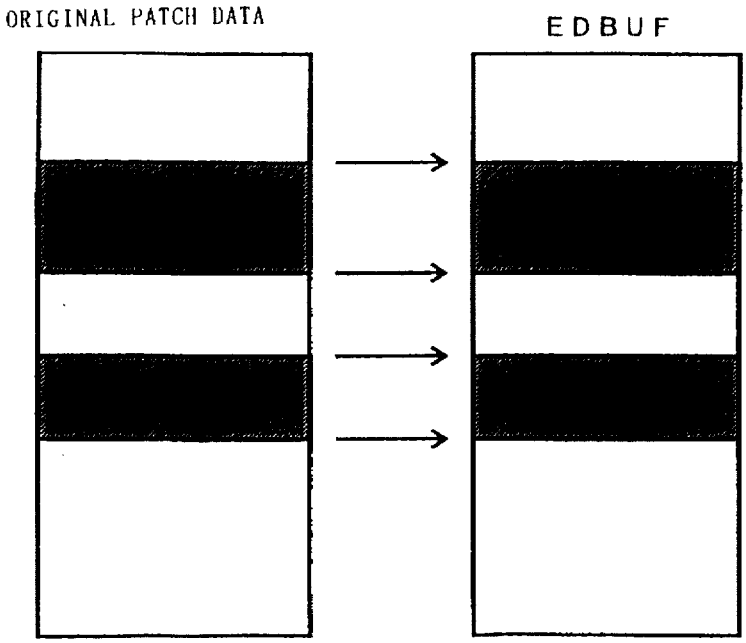
FIG. 19 is a diagram explaining how memory data replacement is effected in patch-by-patch editing.

At step S63 of FIG. 10, a determination is made as to whether any patch pasting (or selection) event has occurred. With a negative determination, the program returns to the main routine, but with an affirmative determination, the program proceeds to step S64, where the parameters corresponding to the pasted (selected) patch are retrieved from the data base and stored into respective storage areas of the edit buffer EDBUF to replace previously stored old parameters. Namely, as shown in FIG. 19A by half-tone dot meshing, the corresponding parameters are stored in the original patch data in the same relative positions as in the edit buffer EDBUF, and thus the parameters are transferred into the buffer EDBUF while maintained in the relative positions so as to together replace the old parameters in the buffer EDBUF.

At next step S65, the contents of the edit buffer EDBUF having undergone the above-described parameter edit process on the patch-by-patch basis are transferred via the data interfaces 17 and 28 to the DSP 25.

As shown in FIGS. 13 to 17, visual representations of a currently selected tone color are given in the upper area of the edit screen, which include letters indicating two selected segments of the exciting mechanism and structure, letters indicating a variation selected in relation to the selected segments, and a schematic drawing symbolically representing (i.e., graphic representation of) the combination of the selected segments. A "Synthesizer" key is displayed in the upper right corner area to be operated when the user wants to return to the tone color selecting screen as shown in FIG. 12.

While in the above-described embodiment, various data editing operators are implemented by the combination of the display 14, keyboard 15 and/or mouse 16, they may be implemented by a plurality of dedicated hardware operators.

The tone generator in the electronic musical instrument may be other than the physical model tone generator. Further, the editor device 10 may be incorporated in the electronic musical instrument or tone synthesizing device rather than being provided separately therefrom, in which case a single MPU may be shared as necessary.

As has been described so far, the present invention is characterized primarily in that characteristics (tone color) of a tone are set or selected by selecting and combining desired segments of musical instrument structures and/or exciting mechanisms. This feature achieves a superior benefit that tone characteristics (tone color) exactly according with the human operator's or user's intuition can be set or selected with ease. Also, the feature allows such setting or selection of tone characteristics (tone color) to be easily done with a relatively high level of freedom, without a need for the user to have a particular knowledge of a complicated tone synthesizing algorithm.

Furthermore, because the present invention allows two or more parameters to be simultaneously set or controlled in response to operation of a single data editing operator, a plurality of related parameters can be adjusted simultaneously without a need to separately operate individual data editing operators corresponding to the parameters. This provides greatly enhanced efficiency and permits parameter adjustment and setting in a manner exactly according with the human operator's or user's feeling.

What is claimed is:

1. A tone setting device for a tone generator which generates a musical tone signal based on tone setting data in accordance with a predetermined algorithm comprising a combination of a plurality of modelling sections, said tone setting device comprising:

memory means for storing a plurality of tone setting data;

operating means for selecting segments in combination from among various segments of exciting mechanisms and structures in plural types of musical instruments or sound generating objects for each of said plurality of modelling sections; and data supply means for reading out from said memory means tone setting data corresponding to the combination of the segments selected by said operating means, as parameter data for setting a characteristic of a tone to be generated in accordance with said predetermined algorithm, and for supplying the read-out tone setting data to the tone generator, whereby said characteristic of the generated tone is set by combining the segments of any of the musical instruments or tone generating structures.

2. A tone setting device as claimed in claim 1 wherein the tone setting data supplied by said data supply means includes a plurality of parameters for setting said characteristic of the generated tone, and which further comprises parameter adjusting means for optionally adjusting a value of any of the parameters.

3. A tone setting device as claimed in claim 1 wherein said operating means classifies the segments of the musical instruments into a plurality of groups in accordance with functions of the segments and selects a desired one of the segments from each of the groups, so as to provide a combination of the segments selected respectively from the groups.

4. A tone setting device as claimed in claim 3 wherein said groups include a group of the segments having a function of exciting vibration in the musical instruments and a group of the segments having a function of causing resonance=in the musical instrument.

5. A tone setting device as claimed in claim 3 wherein said operating means includes display means for displaying the segments selectable for each of the groups.

6. A tone setting device as claimed in claim 5 wherein said display means provides symbolic graphical representations of the exciting mechanisms or structures corresponding to the segments.

7. A tone setting device for a tone generator which generates a musical tone signal based on tone setting data in accordance with a predetermined algorithm, comprising:

memory means for storing a plurality of tone setting data;

operating means for selecting segments in combination from among various segments of exciting mechanisms and structures in plural types of musical instruments or sound generating objects, wherein said operating means includes first means for selecting desired ones of the segments in combination, and second means for, if the combination of the segments selected by said first means has a plurality of variations, selecting a desired one of the variations; and data supply means for reading out from said memory means tone setting data corresponding to the combination of the segments selected by said operating means, as data for setting a characteristic of a tone, and for supplying the read-out tone setting data to the tone generator, whereby a characteristic of a tone to be generated is set by combining the segments of any of the musical instruments or tone generating structures.

8. A method of selecting tone setting data for a tone generator which generates a musical tone based on tone setting data in accordance with a predetermined algorithm comprising a combination of a plurality of modelling sections, said method comprising the steps of:

dividing exciting mechanisms and structures of a plurality of musical instruments or sound generating objects into a plurality of segments corresponding to each of said plurality of modelling sections and displaying the segments on a display;

selecting desired segments displayed on the display for each of said plurality of modelling sections;

providing on the display a representation of a combination of the segments selected by said step of selecting; and supplying tone setting data corresponding to the combination of the selected segments, as parameter data for setting a characteristic of a tone in accordance with said predetermined algorithm.

9. A tone setting device comprising:

at least one data editing operator, said operator being of a type that can be operated to move within respective predetermined ranges in positive and negative regions;

allocating means for allocating at least two parameters for setting or controlling a characteristic of a tone, as parameters to be edited in value via said operator; and control means for, in response to operation of same said operator, variably adjusting values of the parameters to be edited via said operator, by different amounts corresponding to a predetermined operation amount of said operator, each of said different amounts being set separately for each of the positive and negative regions of said operator.

10. A tone setting device as claimed in claim 9 wherein said operator corresponds to a desired expressive tonal characteristic factor, and said at least two parameters allocated by said allocating means for said operator cooperate to set or control a tonal characteristic so as to control said expressive tonal characteristic factor.

11. A tone setting device as claimed in claim 9 which comprises a plurality of said data editing operators, and wherein said allocating means allocates a same parameter to at least two said operators as one of the parameters to be edited.

12. A tone setting device as claimed in claim 11 wherein said control means variably adjusts values of said same parameter allocated to said at least two operators by different amounts corresponding to a predetermined operation amount of said at least two operators.

13. A tone setting device as claimed in claim 9 wherein said operator includes a representation of a virtual operator displayed on a display and switch means associated therewith.

14. A computer-readable memory containing computer-readable instructions to cause a computer to implement a method for selecting tone setting data for a tone generator which generates a musical tone signal based on tone setting data in accordance with a predetermined algorithm comprising a combination of a plurality of modelling sections, said method comprising the steps of:

dividing exciting mechanisms and structures of a plurality of musical instruments or sound generating objects into a plurality of segments corresponding to each of said plurality of modelling sections and displaying the segments on a display;

selecting desired the segments displayed on the display for each of said plurality of modelling sections;

providing on the display a representation of a combination of the segments selected by said step of selecting; and supplying tone setting data corresponding to the combination of the selected segments, as parameter data for setting a characteristic of a tone to be generated in accordance with said predetermined algorithm.

* * * * *